US009871278B2

(12) United States Patent
Kawamura et al.

(10) Patent No.: US 9,871,278 B2
(45) **Date of Patent: *Jan. 16, 2018**

(54) MILLIMETER WAVEBAND FILTER AND METHOD OF VARYING RESONANT FREQUENCY THEREOF

(71) Applicant: ANRITSU CORPORATION, Kanagawa (JP)

(72) Inventors: Takashi Kawamura, Kanagawa (JP); Akihito Otani, Kanagawa (JP); Hiroshi Hasegawa, Kanagawa (JP)

(73) Assignee: ANRITSU CORPORATION, Kanagawa (JP)

( * ) Notice: Subject to any disclaimer, the term of this patent is extended or adjusted under 35 U.S.C. 154(b) by 178 days.

This patent is subject to a terminal disclaimer.

(21) Appl. No.: 14/725,349

(22) Filed: May 29, 2015

(65) Prior Publication Data

US 2015/0263400 A1 Sep. 17, 2015

Related U.S. Application Data

(62) Division of application No. 13/685,820, filed on Nov. 27, 2012, now Pat. No. 9,184,486.

(30) Foreign Application Priority Data

Nov. 30, 2011 (JP) ..... 2011-262520
Nov. 30, 2011 (JP) ..... 2011-262521
(Continued)

(51) Int. Cl.
*H01P 1/207* (2006.01)
*H01P 7/06* (2006.01)
*H01P 7/10* (2006.01)

(52) U.S. Cl.
CPC ..... *H01P 1/207* (2013.01); *H01P 7/06* (2013.01); *H01P 7/10* (2013.01)

(58) Field of Classification Search
CPC ..... H01P 1/042; H01P 1/061; H01P 1/207; H01P 1/208; H01P 1/2138; H01P 3/122; H01P 3/123; H01P 5/181
(Continued)

(56) References Cited

U.S. PATENT DOCUMENTS 2,950,452 A * 8/1960 Marcatili ..... H01P 1/163 333/110
4,849,724 A 7/1989 Koreeda
(Continued)

FOREIGN PATENT DOCUMENTS

JP 61-102803 A 5/1986
JP 63-198202 U1 8/1988
(Continued)

*Primary Examiner* — Benny Lee
*Assistant Examiner* — Hafizur Rahman
(74) *Attorney, Agent, or Firm* — Pearne & Gordon LLP

(57) ABSTRACT

The millimeter waveband filter includes: a transmission line that is formed by a waveguide which propagates electromagnetic waves with a predetermined frequency range of a millimeter waveband from one end to the other end in a TE10 mode; and a pair of radio-wave half mirrors that are disposed opposite each other with a space interposed therebetween so as to block the inside of the transmission line and have planar shapes and a characteristic of transmitting a part of the electromagnetic waves with the predetermined frequency range and reflecting a part thereof. In the electromagnetic waves incident from the one end side of the transmission line, a frequency component centered on a resonant frequency of a resonator, which is formed between the pair of radio-wave half mirrors, is selectively output from the other end of the transmission line.

4 Claims, 23 Drawing Sheets

(30) Foreign Application Priority Data

May 23, 2012 (JP) ..... 2012-117449
Jul. 10, 2012 (JP) ..... 2012-154325

(58) Field of Classification Search
USPC ..... 333/21, 137, 157, 159, 179, 195, 202, 333/208, 209, 212, 219, 227, 231–235, 333/252
See application file for complete search history.

(56) References Cited

U.S. PATENT DOCUMENTS

| | | | | |
|---|---|---|---|---|
| 5,012,212 | A * | 4/1991 | Matsui | H01P 7/00 333/227 |
| 5,942,956 | A * | 8/1999 | Haq | G02B 6/14 333/21 R |
| 2007/0141567 | A1* | 6/2007 | Wulfman | C12Q 1/6837 435/6.11 |
| 2012/0126914 | A1 | 5/2012 | Miyamoto et al. | |

FOREIGN PATENT DOCUMENTS

| | | | |
|---|---|---|---|
| JP | 1-152801 | A | 6/1989 |
| JP | 2-62806 | | 5/1990 |
| JP | 4-61844 | U1 | 2/1992 |
| JP | 2005-108449 | | 4/2005 |
| JP | 2011-9806 | A | 1/2011 |

* cited by examiner

| | NO GAP | GAP OF 20μm AND GROOVE | GAP OF 20μm AND NO GROOVE |
|---|---|---|---|
| CENTER FREQUENCY (GHz) | 133.523 | 133.118 | 133.243 |
| INSERTION LOSS (dB) | 2.34 | 3.67 | 19.19 |
| 3dB BANDWIDTH (GHz) | 0.280 | 0.343 | 0.964 |
| Q | 477 | 388 | 138 |

$S_{21}$ FREQUENCY CHARACTERISTICS a : LONG SIDE LENGTH OF WAVEGUIDE OF RECTANGULAR CROSS-SECTION
b : SHORT SIDE LENGTH OF WAVEGUIDE OF RECTANGULAR CROSS-SECTION

SIMULATION RESULT

WAVEGUIDE 122 (122a, 122b, 122c)

a =2.032mm
b =1.016mm

MILLIMETER WAVEBAND FILTER AND METHOD OF VARYING RESONANT FREQUENCY THEREOF

This application is a divisional of U.S. patent application Ser. No. 13/685,820 filed on Nov. 27, 2012, the entire content of which is hereby incorporated by reference herein.

TECHNICAL FIELD

The present invention relates to a filter used in a millimeter waveband.

BACKGROUND ART

Recently, as a ubiquitous network society has been realized, there has been an increase in the demand to use radio waves. In this situation, it has started to use millimeter waveband wireless systems such as a WPAN (wireless personal area network), which achieve wireless broadband in the home, and a millimeter wave radar which supports safe and comfortable driving. Further, efforts are being made to achieve a wireless system used at a frequency of 100 GHz or more.

Meanwhile, regarding evaluation of a second-order harmonic of a wireless system of a band of 60 GHz to 70 GHz, or evaluation of a wireless signal in a frequency band of more than 100 GHz, as the frequency increases, the conversion loss of the mixer and the noise level of the measuring instrument increase, and the frequency accuracy decreases. For this reason, a technique for high-sensitivity and high-accuracy measurement of the wireless signal of more than 100 GHz has not been established. Furthermore, in the existing measurement techniques, the locally-generated harmonics cannot be separated from the measurement result, and it is difficult to perform precise measurement of undesired emission and the like.

In order to solve such a technical problem, it is necessary to achieve high-sensitivity and high-accuracy measurement of a wireless signal using a wideband of 100 GHz or more. Hence, it is necessary to develop a narrowband filter technique for the millimeter waveband for inhibiting image responses and high-order harmonic responses, and particularly a variable-frequency (tunable) type technique is preferred.

Until now, as the filter used as a variable-frequency type in the millimeter waveband, (a) a filter which uses a YIG resonator, (b) a filter in which a varactor diode is added to a resonator, and (c) a Fabry-Perot resonator have been known.

As the filter which uses the YIG resonator in (a), there is a known filter which can be used in a range up to about 80 GHz in a present situation. In addition, as the filter in which the varactor diode is added to the resonator in (b), there is a known filter which can be used in a range up to about 40 GHz. However, it is difficult to manufacture a filter which can be used at a frequency more than 100 GHz.

In contrast, the Fabry-Perot resonator in (c) has been widely used in the optical field, and a technique for using the resonator for millimeter waves is disclosed in Non-Patent Document 1. Non-Patent Document 1 discloses a confocal Fabry-Perot resonator which achieves high Q by having a pair of spherical reflective mirrors reflecting the millimeter waves opposite each other with a space equal to the radius of curvature thereof.

RELATED ART DOCUMENT

Non-Patent Document

[Non-Patent Document 1] "Modern Millimeter Wave Technologies" Tasuku Teshirogi and Tsukasa Yoneyama, Ohmsha, 1993, p 71

DISCLOSURE OF THE INVENTION

Problem that the Invention is to Solve

However, in the confocal Fabry-Perot resonator, in a case of changing a distance between mirror surfaces in order to tune a passband, the focus thereof is, in principle, out of focus, and thus it can be expected that Q drastically decreases. Consequently, the pair of reflective mirrors, of which the curvature is different, has to be selectively used for each frequency.

Meanwhile, there is a Fabry-Perot resonator widely used in the optical field, which is a resonator having a structure in which planar half mirrors are disposed opposite each other. In this structure, in principle Q does not decrease even when the distance between the mirror surfaces is changed. However, in order to achieve the filter using the plane-type Fabry-Perot resonator in the millimeter waveband, there are the following further problems to be solved.

(A) It is necessary that plane waves are incident in parallel on the half mirrors. In a case where the input to the filter is through the waveguide, it is contemplated that the plane waves are achieved by increasing the rectangular size thereof like that of the horn antenna, but the size thereof increases. Even in this case, it is difficult to achieve perfect plane waves, and characteristics thereof deteriorate.

(B) It is necessary for the half mirror to have a function of transmitting a constant amount of the plane waves as they are. For this reason, the structure of the half mirrors is limited, and thus a degree of freedom in design is low.

(C) Since the resonator is an open type, loss caused by spatial radiation is large.

In order to solve the above-mentioned problems, it is an object of the present invention to provide a millimeter waveband filter which has no deterioration in characteristics caused by wavefront conversion and gives a high degree of freedom in design of the radio-wave half mirrors and through which loss caused by spatial radiation is low.

Means for Solving the Problems

In order to achieve the above-mentioned object, a millimeter waveband filter is provided according to the present disclosure, including:

a transmission line that is formed by a waveguide into which electromagnetic waves with a predetermined frequency range of a millimeter waveband are incident and which propagates the corresponding incident electromagnetic waves from one end to the other end in a TE10 mode; and a pair of radio-wave half mirrors that are disposed opposite each other with a space interposed therebetween so as to block the inside of the transmission line and have planar shapes and a characteristic of transmitting a part of the electromagnetic waves with the predetermined frequency range and reflecting another part thereof.

In the electromagnetic waves incident from the one end side of the transmission line, a frequency component centered on a resonant frequency of a resonator, which is formed between the pair of radio-wave half mirrors, is selectively output from the other end of the transmission line.

According to a further aspect of the present disclosure, in order to change an electrical length between the pair of radio-wave half mirrors, at least one of space-varying means, which varies a space between the pair of radio-wave half mirrors, and permittivity-varying means, which varies permittivity of a dielectric material inserted between the pair of radio-wave half mirrors, is provided.

According to a further aspect of the present disclosure, the transmission line is formed by one waveguide continuing with a same internal rectangular size.

According to a further aspect of the present disclosure, the transmission line is formed of:

a first waveguide which has an internal rectangular size capable of propagating the electromagnetic waves with the predetermined frequency range from the one end to the other end in the TE10 mode, and a second waveguide which has an internal rectangular size capable of propagating the electromagnetic waves with the predetermined frequency range from the one end to the other end in the TE10 mode and is connected to the first waveguide so as to be circumscribed around the end portion of the first waveguide.

One of the pair of radio-wave half mirrors is mounted on the first waveguide, and the other is mounted on the second waveguide.

The space-varying means varies the space between the pair of radio-wave half mirrors by telescopically sliding the first waveguide and the second waveguide in a state where the waveguides are connected.

According to a further aspect of the present disclosure, in the second waveguide, a first transmission line, which has a rectangular size capable of housing the one end side of the first waveguide with a gap necessary to slide the one end side, and a second transmission line, which has a rectangular size equal to that of the transmission line of the first waveguide, are integrally formed so as to be concentrically successive, and a groove with a predetermined depth for inhibiting electromagnetic waves from leaking is formed around an inner circumferential wall of the first transmission line which is opposed to an outer circumference of the first waveguide with a gap.

According to a further aspect of the present disclosure, an air duct, which continues from an inner circumference of the second waveguide to an outer circumference thereof, is provided in a range between the pair of radio-wave half mirrors.

According to a further aspect of the present disclosure, the transmission line is formed of a first waveguide which has an internal rectangular size capable of propagating the electromagnetic waves with the predetermined frequency range from the one end to the other end in the TE10 mode, a second waveguide which has an internal rectangular size and a shape the same as those of the first waveguide and is disposed on an axis the same as that of the first waveguide in a state where one end side of the second waveguide is opposed to one end side of the first waveguide, and a third waveguide which has an internal rectangular size capable of propagating the electromagnetic waves with the predetermined frequency range from the one end to the other end in the TE10 mode and circumscribing the first waveguide and second waveguide and holds the first waveguide and second waveguide so as to inscribe at least the one end sides of the first waveguide and the second waveguide.

One of the pair of radio-wave half mirrors is mounted on the first waveguide, and the other is mounted on the second waveguide.

The space-varying means slides at least one of the first waveguide and the second waveguide in a state where the at least one is held in sliding contact in the third waveguide.

According to a further aspect of the present disclosure, in the third waveguide, the one end side of the waveguide, which slides relative to the third waveguide, between the first waveguide and the second waveguide is formed to be housed with a gap necessary for the slide, and a groove with a predetermined depth for inhibiting electromagnetic waves from leaking is formed around an inner circumferential wall which is opposed to an outer circumference of the housed waveguide with a gap.

According to a further aspect of the present disclosure, an air duct, which continues from an inner circumference of the third waveguide to an outer circumference thereof, is provided in a range between the pair of radio-wave half mirrors.

Further, the present disclosure provides a method of varying a resonant frequency of a millimeter waveband filter including: a transmission line that is formed by a waveguide which propagates electromagnetic waves with a predetermined frequency range of a millimeter waveband from one end to the other end in a TE10 mode; and a pair of radio-wave half mirrors that are disposed opposite each other with a space interposed therebetween so as to block the inside of the transmission line and have planar shapes and a characteristic of transmitting a part of the electromagnetic waves with the predetermined frequency range and reflecting a part thereof. The method is characterized to include: outputting a frequency component centered on a resonant frequency of a resonator, which is formed between the pair of radio-wave half mirrors, selectively in the electromagnetic waves, which is incident from the one end side of the transmission line, from the other end of the transmission line; and varying the resonant frequency by varying a space between the pair of radio-wave half mirrors or varying permittivity of a dielectric material inserted between the pair of radio-wave half mirrors.

According to a further aspect of the present disclosure, a millimeter waveband filter is characterized to include: a waveguide that has a transmission line which has a cross-sectional rectangular shape and propagates electromagnetic waves with a predetermined frequency range of a millimeter waveband from one end to the other end in a TE10 mode; and a pair of radio-wave half mirrors that have a characteristic of transmitting a part of the electromagnetic waves with the predetermined frequency range and reflecting a part thereof and are fixed at a predetermined distance away from each other so as to block the transmission line in the waveguide. The millimeter waveband filter selectively passes electromagnetic waves with a resonant frequency of a resonator, which is formed between the pair of radio-wave half mirrors, in the electromagnetic waves with the predetermined frequency range. The waveguide has a structure capable of varying a space between wall surfaces, which correspond to short sides of the cross-sectional rectangle, among four wall surfaces enclosing the transmission line which has a cross-sectional rectangular shape formed between the pair of radio-wave half mirrors. The resonant frequency can be varied by the variance of the space between the wall surfaces corresponding to the short sides thereof.

According to a further aspect of the present disclosure, the millimeter waveband filter is characterized in that there is provided an air duct continuing to an outer circumferential surface of the waveguide from the wall surfaces, which correspond to short sides of the cross-sectional rectangle, among the four wall surfaces enclosing the transmission line which has the cross-sectional rectangular shape formed between the pair of radio-wave half mirrors.

Advantage of the Invention

As described above, the millimeter waveband filter of the present invention has a structure in which the pair of planar radio-wave half mirrors are disposed in the transmission line, which is formed by the waveguide propagating electromagnetic waves with a predetermined frequency range of a millimeter waveband from one end to the other end in the TE10 mode, opposite each other with a space interposed therebetween. In the structure, the frequency component centered on the resonant frequency is selected from the electromagnetic waves, which are input from one end side of the transmission line, and output from the other side by the resonator which is formed between the pair of radio-wave half mirrors.

As described above, there is provided the resonator which is formed of the pair of radio-wave half mirrors having planar shapes inside the transmission line that transfers waves only in the TE10 mode. In the structure, the special study for incidence of the plane waves is not necessary, and the radio-wave half mirrors can be formed in an arbitrary shape such that it is not necessary to transmit the plane waves.

Further, the entire filter is hermetically formed, so in principle there is no loss caused by radiation to the surroundings, and it is possible to achieve an extremely high selective property in the millimeter waveband.

Furthermore, in order to change an electrical length between the radio-wave half mirrors, at least one of space-varying means, which varies a space between the radio-wave half mirrors, and permittivity-varying means, which varies permittivity of a dielectric material inserted between the radio-wave half mirrors, is provided. In the structure, it is possible to freely vary the resonant frequency of the resonator, and it is possible to achieve a filter capable of varying the resonant frequency with low loss.

In addition, the transmission line has a structure in which two or three waveguides are connected and the pair of radio-wave half mirrors is respectively mounted on different waveguides. Thus, it is possible to vary the mirror space through the slide of the waveguide, and it is possible to easily change the resonant frequency.

Further, in the millimeter waveband filter formed of two waveguides, the groove with the predetermined depth for inhibiting electromagnetic waves from leaking is formed around the inner circumferential wall of the first transmission line of the second waveguide. In the structure, it is possible to prevent the electromagnetic waves between the radio-wave half mirrors from leaking out through the gap necessary for the slide, and it is possible to keep the filter characteristic high.

Furthermore, in the millimeter waveband filter formed of three waveguides, the groove with the predetermined depth for inhibiting electromagnetic waves from leaking is formed around the inner circumferential wall of the third waveguide which is opposed with a gap to the outer circumference of the waveguide of one of the first waveguide and the second waveguide sliding relative to the third waveguide. In the structure, it is possible to prevent the electromagnetic waves between the radio-wave half mirrors from leaking out to the outside through the gap necessary for the slide it is possible to keep the filter characteristic high.

In addition, there is provided the air duct which continues from the inner circumference of the waveguide enclosing the circumference thereof to the outer circumference thereof in the range between the pair of radio-wave half mirrors. In the structure, even when the gap necessary for the slide is made to be narrow, it is possible to reduce the air resistance at the time of varying the frequency through the air duct, and thus it is possible to prevent the distortion of the radio-wave half mirrors caused by the air resistance from occurring. As a result, it is not necessary to apply excessive power to the slide.

Further, in order to change the electrical length between the radio-wave half mirrors, it is possible to vary the space between the wall surfaces, which correspond to short sides of the cross-sectional rectangle, among the four wall surfaces enclosing the transmission line which has the cross-sectional rectangular shape formed between the pair of radio-wave half mirrors. In the structure, it is possible to vary the resonant frequency through the variation of the space between the wall surfaces corresponding to the short sides thereof, and therefore it is possible to form the filter with a small size. Furthermore, in the configuration in which the air duct is provided, it is possible to prevent the distortion of the radio-wave half mirrors, which is caused by the air pressure at the time of varying the frequency, from occurring, and thus it is possible to stably vary the frequency.

BEST MODE FOR CARRYING OUT THE INVENTION

Hereinafter, embodiments of the present invention will be described with reference to the accompanying drawings.

Figure 1:
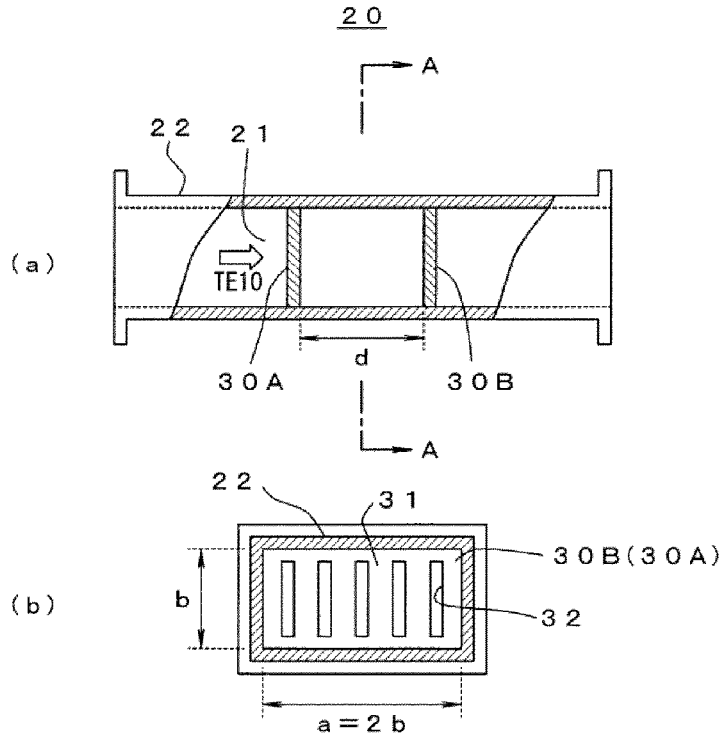
FIGS. 1*a* and 1*b* are diagrams of a basic structure of a millimeter waveband filter of the present invention.

FIG. 1 shows a basic structure of a millimeter waveband filter 20 of the present invention.

The millimeter waveband filter 20 includes: a transmission line 21 that is formed with a predetermined length by a rectangular waveguide 22 with an internal rectangular size (for example, an internal rectangular size a×b=2.032 mm×1.016 mm) which propagates electromagnetic waves with a predetermined frequency range (for example, 110 to 140 GHz) of a millimeter waveband in the TE10 mode; and a pair of radio-wave half mirrors 30A and 30B that are disposed opposite each other with a space d interposed therebetween so as to block the inside of the transmission line 21 and have planar shapes and a characteristic of transmitting a part of the electromagnetic waves with the predetermined frequency range propagated in the TE10 mode and reflecting a part thereof. It should be noted that FIG. 1(*a*) is a side view and FIG. 1(*b*) shows the cross-section taken along the line A-A.

In FIG. 1, as a simplest structure for forming the transmission line 21, the one continuous rectangular waveguide 22 is employed. However, as described later, the transmission line 21 may be formed to have a structure, in which two or three waveguides are connected, as a structure for easily varying the frequency.

As shown in FIG. 1(*b*), each of the radio-wave half mirrors 30A and 30B has a structure in which the slits 32 for transmitting electromagnetic waves are provided on the metal plate 31 having a rectangular shape which is inscribed in the transmission line 21, thereby transmitting the electromagnetic waves at a transmittance corresponding to the area or the shape of the slits 32.

In the millimeter waveband filter 20 having such a basic structure, a plane-type Fabry-Perot resonator, which resonates at an electrical length (an electrical length depending on a physical length d and an internal permittivity) of a half wavelength between the pair of radio-wave half mirrors 30A and 30B opposed to each other, is formed, whereby only the frequency component centered on the resonant frequency thereof can be selectively transmitted.

Further, the transmission line 21 is formed to have a structure of a waveguide as a closed-type transmission channel which has extremely low loss in the millimeter waveband, and uses transverse electric waves of which the electric field is present only in the plane orthogonal to the traveling direction. Hence, the processes such as wavefront conversion are not necessary, and thus only the signal component extracted through the resonator can be output with extremely low loss in the TE10 mode.

Figure 2:
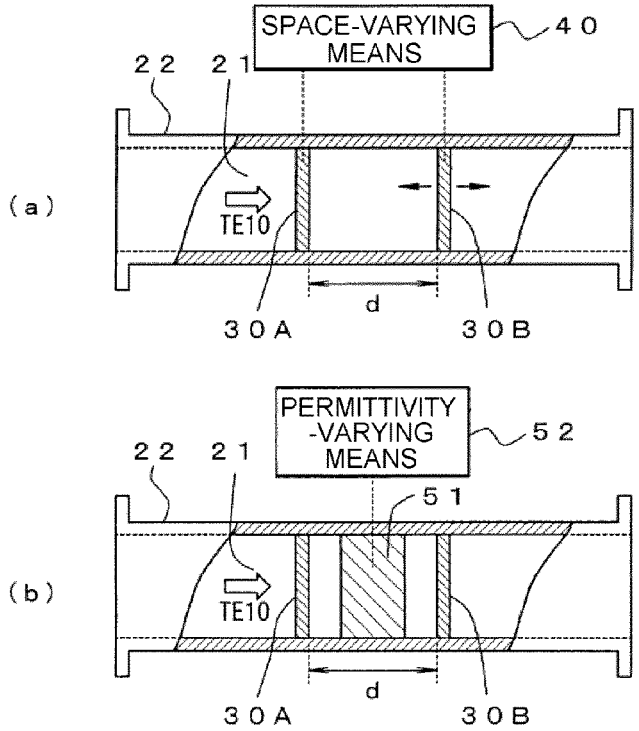
FIGS. 2*a* and 2*b* are diagrams illustrating a configuration for changing the resonant frequency of the filter.

Here, as shown in FIG. 2(*a*), the space d between the radio-wave half mirrors 30A and 30B can be set to be varied by space-varying means 40, or as shown in FIG. 2(*b*), the permittivity of the dielectric material 51 inserted between the mirrors can be varied by the electric signal from the permittivity-varying means 52. Alternatively, both are used in combination. Thereby, it is possible to freely vary the electrical length (that is, the resonant frequency) between the mirrors, and thus it is possible to achieve a variable-frequency-type filter which has extremely loss in the millimeter waveband.

As the space-varying means 40 in the basic structure, various configurations can be considered. However, when the transmission line is formed of one continuous waveguide as shown in the above example, a mechanism, which fix one radio-wave half mirror 31 at a predetermined position in the tube and slides the other radio-wave half mirror 32 in the tube, can be considered. Further, as the dielectric material 51 for varying the permittivity, for example, it is possible to use liquid crystal.

Next, a more specific structure of the variable-frequency-type millimeter waveband filter will be described.

Figure 3:
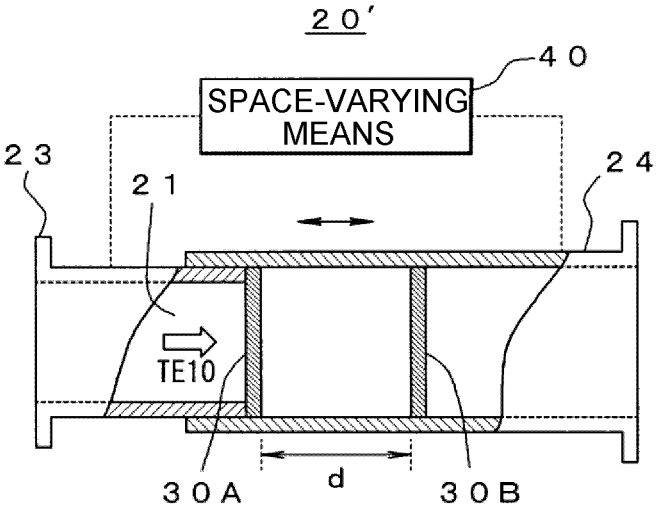
FIG. 3 is a diagram illustrating an example of a structure using waveguides with two different diameters.

FIG. 3 shows a millimeter waveband filter 20' in which the transmission line 21 is formed by a first waveguide 23 and a second waveguide 24 with different rectangular sizes.

Likewise, the first waveguide 23 forming the transmission line 21 of the millimeter waveband filter 20' is the rectangular waveguide with the internal rectangular size (for example, the internal rectangular size a×b=2.032 mm×1.016 mm) which propagates electromagnetic waves with the predetermined frequency range (for example, 110 to 140 GHz) of the millimeter waveband in the TE10 mode, where the one radio-wave half mirror 30A is fixed to block the opening of the one end side.

Further, the second waveguide 24 is connected to the first waveguide 23 in a state where the internal rectangular size of the second waveguide 24 is circumscribed around one end side of the first waveguide 23, and the other radio-wave half mirror 30B is fixed therein.

In the structure in which the radio-wave half mirrors 30A and 30B are respectively fixed in a state where the waveguides 23 and 24 with different rectangular sizes are connected in such a manner, the space-varying means 40 telescopically slides the first waveguide 23 and the second waveguide 24 in a state where those are connected. Thereby, it is possible to vary the space d between the pair of the radio-wave half mirrors 30A and 30B, and the resonant frequency can be freely set.

In addition, in this structure, the internal rectangular size of the second waveguide 24 is equal to the sum of the internal rectangular size of the first waveguide 23, the thickness thereof, and the extra distance for the slide. Therefore, the frequency range in which the waves can be propagated in the TE10 mode is shifted to a region less than that of the first waveguide 23. However, by setting the sum of the thickness of the waveguide and the extra distance for the slide to about 0.1 mm relative to the internal rectangular size (about 2 mm×1 mm), it is possible to reduce the shift amount thereof.

Figure 4:
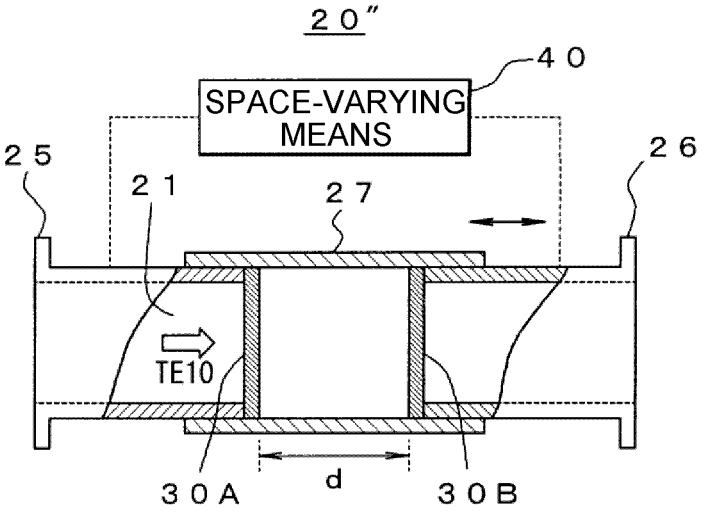
FIG. 4 is a diagram illustrating an example of a structure using three waveguides.

FIG. 4 shows a millimeter waveband filter 20" in which the transmission line 21 is formed by a first waveguide 25 and a second waveguide 26 with the same shapes and a third waveguide 27 of which the rectangular size is slightly larger than those of the tubes.

Likewise, each of the first waveguide 25 and the second waveguide 26 forming the transmission line 21 of the millimeter waveband filter 20" is the rectangular waveguide (WR-08) with the internal rectangular size (for example, the internal rectangular size a×b=2.032 mm×1.016 mm) which propagates electromagnetic waves with the predetermined frequency range (for example, 110 to 140 GHz) of the millimeter waveband in the TE10 mode, where the one radio-wave half mirror 30A is fixed to block the opening of the one end side.

Further, one end side of the second waveguide 26 having the same shape as the first waveguide 25 is disposed opposite one end side of the first waveguide 25 on the same axis, and the other radio-wave half mirror 30B is fixed to block the opening on the one end side.

The third waveguide 27 has an internal rectangular size capable of circumscribing the first waveguide 25 and the second waveguide 26, and holds and connects both waveguides 25 and 26 so as to be circumscribed with the internal rectangular size around one end sides of the first waveguide 25 and the second waveguide 26. Here, in a similar manner as the waveguide 24, the internal rectangular size of the third waveguide 27 is equal to the sum of the internal rectangular sizes of the first waveguide 25 and the second waveguide 26, the thicknesses thereof, and the extra distance for the slide. However, by setting the thicknesses and the extra distance to minute values relative to the rectangular sizes, it is possible to set the amount of lowering in the frequency range capable of propagating waves in the TE10 mode (single mode).

In addition, likewise, the space-varying means 40 telescopically slides at least one of the first waveguide 25, in which one radio-wave half mirror 30A is fixed, and the second waveguide 26, in which the other radio-wave half mirror 30B is fixed, in a state where those are held to be circumscribed around the third waveguide 27. Thereby, it is possible to vary the space d between the pair of the radio-wave half mirrors 30A and 30B, and the resonant frequency can be freely set.

Further, in the millimeter waveband filter 20", both ends of the transmission line 21 are formed as the waveguides 25 and 26 with the same rectangular sizes, a waveguide, which has a standard rectangular size capable of propagating waves of 110 to 140 GHz in the TE10 mode, can be used, and a general-purpose waveguide can be used in connecting to a circuit for inputting/outputting electromagnetic waves as they are. Thereby it becomes extremely easy to build a circuit including the filter. In addition, when the waveguide having the same rectangular size as the first waveguide 23 is mounted on the other end side of the second waveguide 24 with the structure of FIG. 3, similarly to the millimeter waveband filter 20", the general-purpose waveguide can be used in connecting to another circuit.

Next, a simulation result of the millimeter waveband filter 20" with the structure of FIG. 4 will be described below. Further, in order to simplify the simulation, a model, in which the materials are perfect conductors and the conductor loss is not present, is used.

Figure 5:
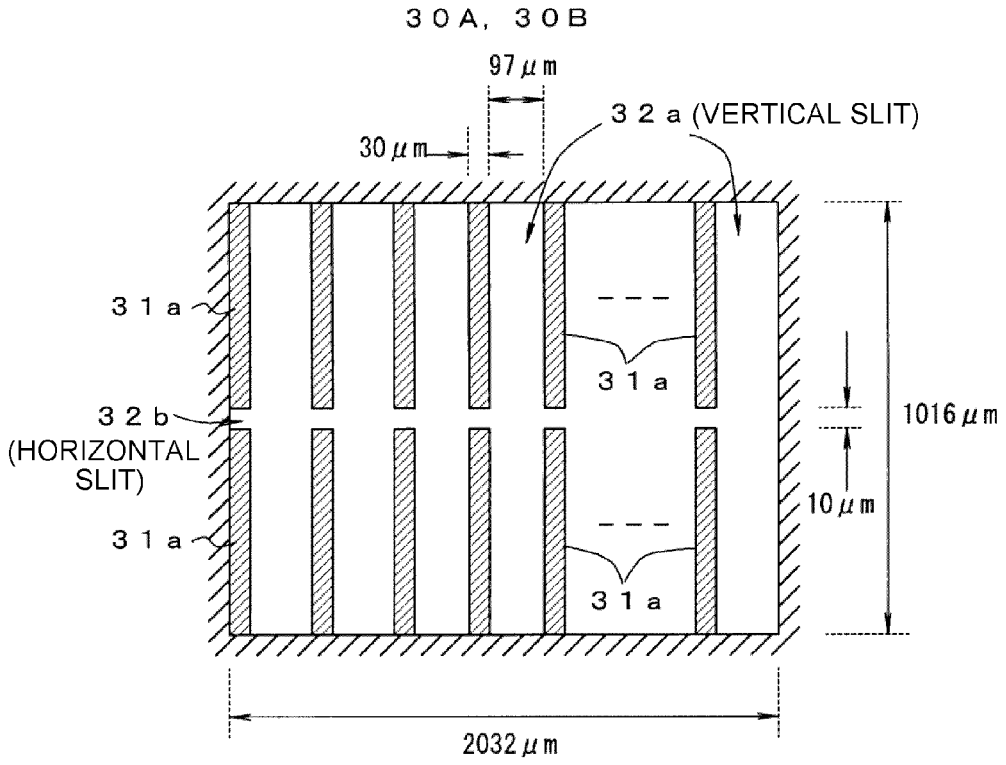
FIG. 5 is a diagram of a structure of radio-wave half mirrors used in simulation.
Figure 6:
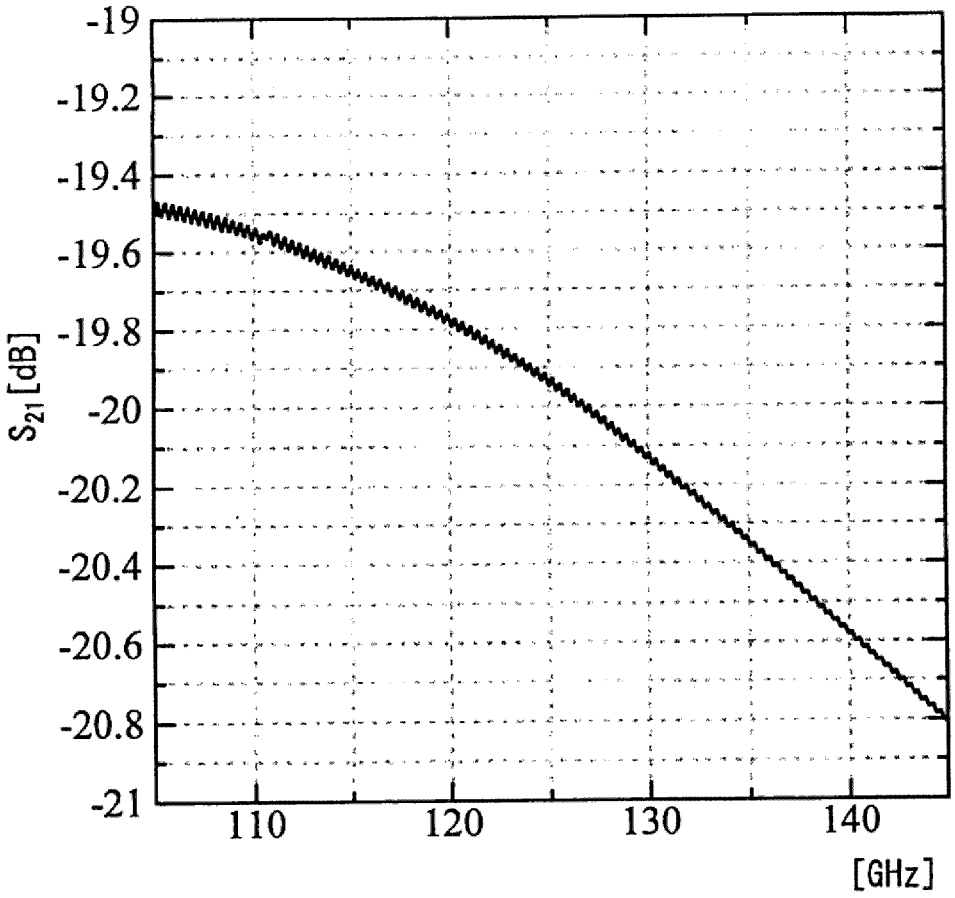
FIG. 6 is a diagram of a frequency characteristic of the radio-wave half mirrors used in simulation.

Furthermore, each of the first waveguide 25 and the second waveguide 26 is the waveguide with the standard rectangular size (internal rectangular size 2.032 mm×1.016 mm) of the thickness of 0.1 mm, and uses each of the radio-wave half mirrors 30A and 30B fixed on the leading ends thereof. As shown in FIG. 5, each of the radio-wave half mirrors 30A and 30B has a rectangular shape inscribed in the waveguide. In each mirror, metal band plates 31*a*, each of which has a thickness of 100 μm and a width of 30 μm and which extends in the short side direction, are arranged in the long side direction (horizontal direction) with vertical slits 32*a*, each of which has a width of 97 μm, interposed therebetween, and are arranged in up and down two stages with horizontal slits 32*b* of 10 μm interposed therebetween. FIG. 6 shows a frequency characteristic of the transmittance $S_{21}$ of the radio-wave half mirrors 30A and 30B.

Figure 7:
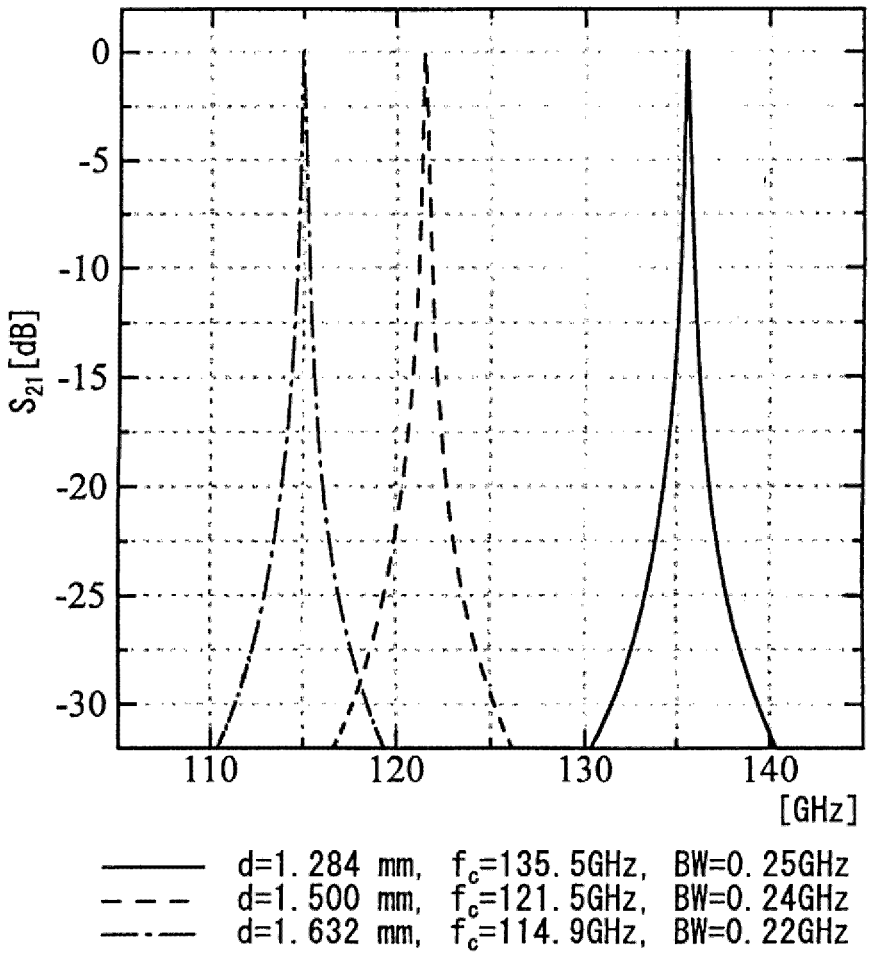
FIG. 7 is a diagram of frequency characteristics of the filter for different mirror spaces in the structure of three waveguides.

FIG. 7 shows frequency characteristics of the transmittance $S_{21}$ of the entire filter at the time of changing the distance d between the radio-wave half mirrors 30A and 30B. The resonant frequency is changed to 135.5 GHz, 121.5 GHz, and 114.9 GHz respectively at the distance d=1.284 mm, 1.500 mm, and 1.632 mm, but the peak value of each resonance characteristic is almost 0 dB. Thus, it is possible to obtain a characteristic of extremely low loss (that is, narrowband) in a wide frequency range. It can be seen from the characteristic that the rectangular size of the third waveguide 27 is slightly larger than the standard rectangular size, and thus it can be said that deterioration in filter characteristics is extremely small.

It should be noted that the structure of the half mirrors used in the simulation does not limit the present invention, and the positions, the shapes, and the like of the slits are arbitrary.

Further, in the above-mentioned millimeter waveband filters 20' and 20", the space-varying means 40 varies the space between the radio-wave half mirrors 30A and 30B so as to change the resonant frequency by sliding the waveguide. In a case of the combined use of permittivity-varying means 52 which changes the permittivity of the dielectric material 51 disposed between the mirrors in response to the electric signal from the outside in addition to the space change performed by the space-varying means 40, it is possible to perform control to more minutely vary the resonant frequency.

In the structure of two waveguides of FIG. 3, in order to slide the first waveguide 23 relative to the second waveguide 24, it is necessary to provide the gap necessary for the slide. However, when the gap is large, the electromagnetic waves between the radio-wave half mirrors leaks out, and thus the filter characteristic is remarkably lowered.

For example, in the case of the waveguide with the rectangular size of about 2 mm×1 mm, an allowable gap G is 20 μm or less. However, even when the gap is suppressed to that extent, it is difficult to perfectly prevent the electromagnetic waves from leaking.

Figures 8, 9:
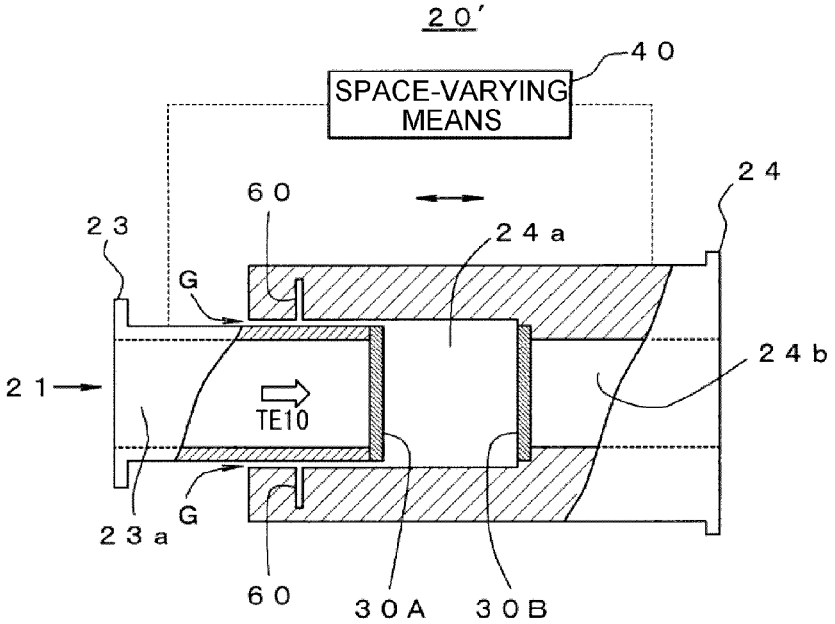
FIG. 8 is a diagram of a structure of a filter provided with a groove for inhibiting electromagnetic waves from leaking in the structure of two waveguides.
FIG. 9 is a simulation result indicating the difference in filter characteristics between presence and absence of the groove for inhibiting electromagnetic waves from leaking.

When the characteristic in which the leakage of the electromagnetic waves is not negligible is required, it is preferable to employ the structure shown in FIG. 8.

That is, in the second waveguide 24, a first transmission line 24*a*, which has a rectangular size capable of housing the one end side of the first waveguide 23 with a gap G necessary to slide the one end side, and a second transmission line 24*b*, which has a rectangular size equal to that of the transmission line 23*a* of the first waveguide 23, are integrally formed so as to be concentrically successive. In addition, a groove (choke) 60 with a predetermined depth for inhibiting electromagnetic waves from leaking is formed around an inner circumferential wall of the first transmission line 24*a* which is opposed to an outer circumference of the first waveguide 23 with a gap G.

It is preferable to set the depth to ¼ (for example, about 0.7 mm at 120 GHz) of the guide wavelength (λg) at the rejection frequency. Although the width is independent of the rejection frequency, it is preferable that the width be, for example, 0.2 mm. Further, when the rejection frequency is set as broad band, it is preferable that a plurality of grooves with different depths be formed with predetermined spaces interposed therebetween.

Figure 10:
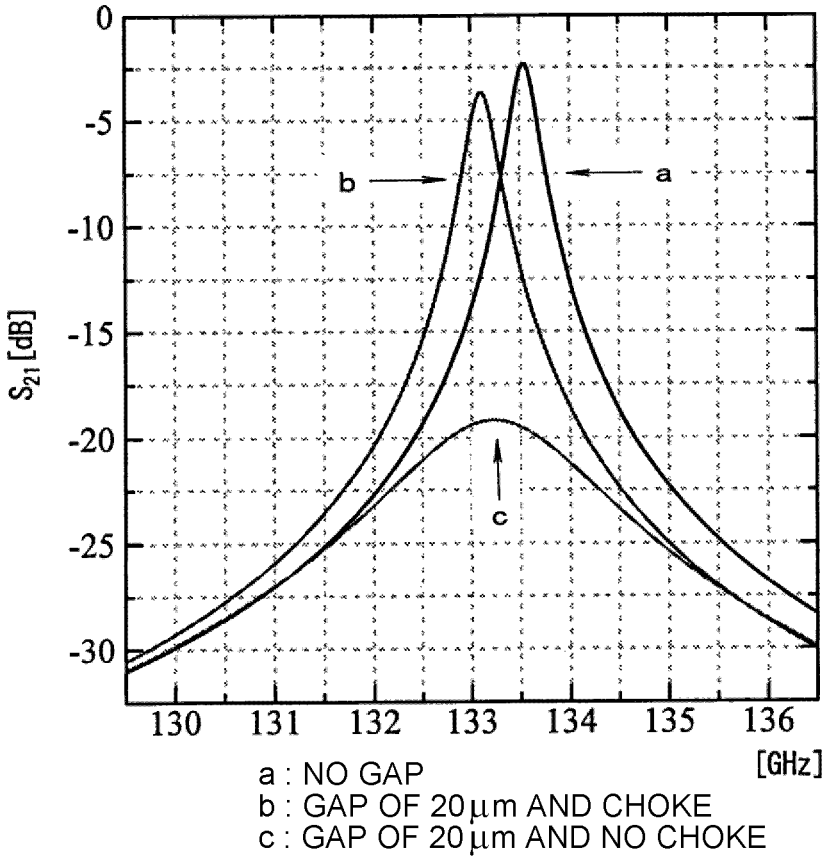
FIG. 10 is a simulation result indicating the difference in filter characteristics between presence and absence of the groove for inhibiting electromagnetic waves from leaking.

FIGS. 9 and 10 show the results of the simulations for observing the effect of the leakage of the electromagnetic waves. FIG. 9 shows measurement results of the center frequency, the insertion loss, the 3 dB bandwidth, and Q value of the filter in the state a where the gap G is absent (ideal condition), the state b where the gap G=20 μm and the groove 60 having a depth of 0.7 mm and a width of 0.2 mm is provided, and the state c where the gap G=20 μm and the groove 60 is not provided. FIG. 10 shows transmission characteristics at the time of varying the frequency of the input signal.

It can be seen from such simulation results that, relative to the ideal condition, when gap G=20 μm and the groove is absent, the insertion loss deteriorates by 16.85 dB, the bandwidth (selectivity) deteriorates by not less than 3.4 times, and Q value is lowered up to 29 percent. In contrast, relative to the ideal condition, when the gap G=20 μm and the groove is present, the insertion loss deteriorates by 1.3 dB, the bandwidth (selectivity) deteriorates by 1.2 times, and Q value is lowered only up to 81 percent. It can be seen from the characteristics of FIG. 10 that it is possible to obtain characteristics close to the ideal condition and it is possible to inhibit deterioration in characteristics caused by the effect of leakage of the electromagnetic waves due to the groove 60 even when there is the gap G necessary for the slide.

In addition, in the case where the narrow gap is provided as described above, when the first waveguide 23 is moved relative to the second waveguide 24 at a comparatively high speed, the volume of the space between the pair of radio-wave half mirrors 30A and 30B increases or decreases. However, since air present therein does not flow out through the narrow gap G (air resistance is large), it is difficult to move the tube at a desired speed unless extra strong force is applied.

Then, when the excessive force is applied, the internal pressure is changed, the thin radio-wave half mirrors 30A and 30B are distorted by the pressure, and the resonant frequency of the filter deviates from a desired value. Thus, there is a possibility that a problem arises in that for example the loss increases.

Figure 11:
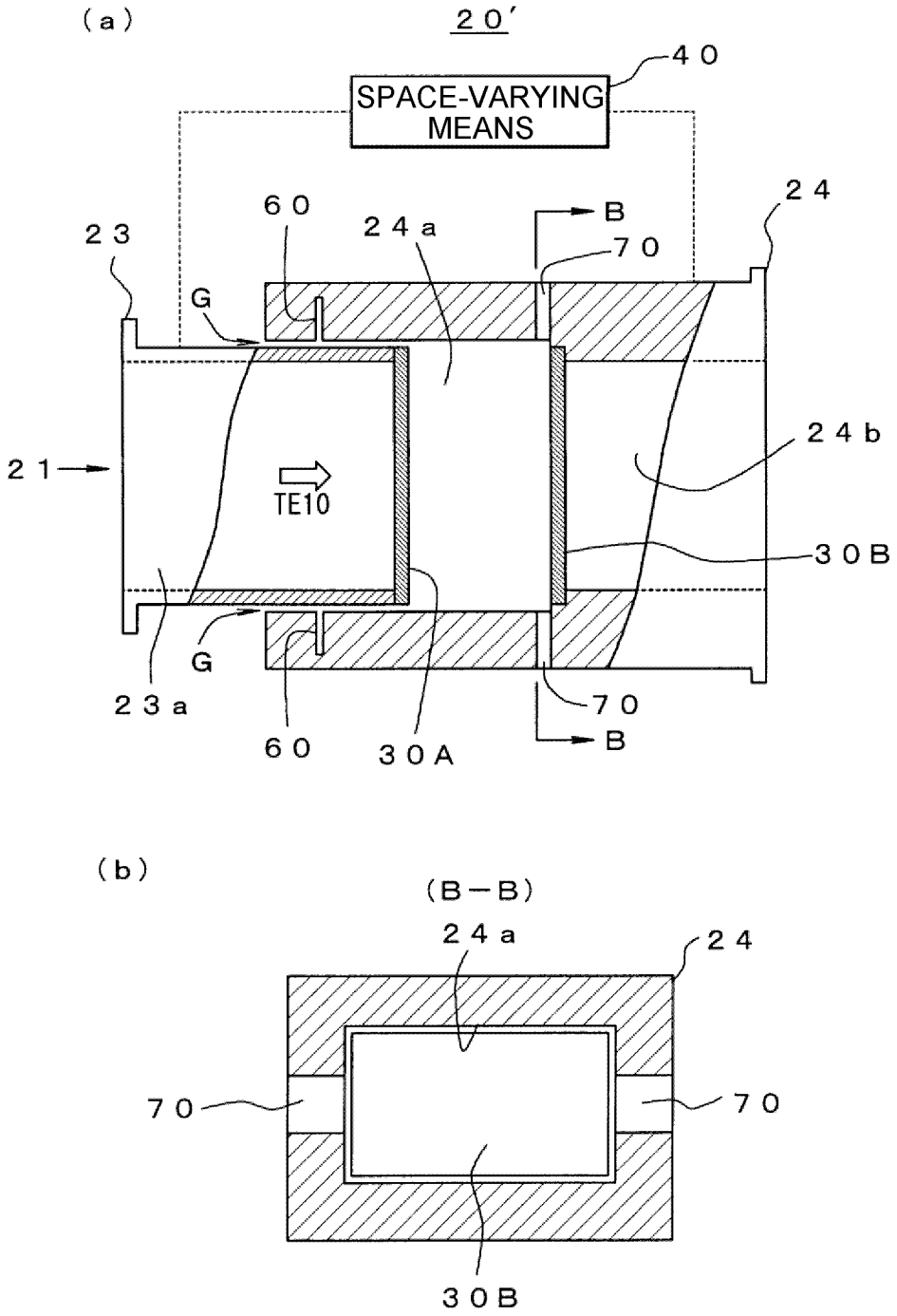
FIGS. 11*a* and 11*b* are diagrams of a structure of a filter provided with an air duct and the groove for inhibiting electromagnetic waves from leaking in the structure of two waveguides.

In the case where the effect of the pressure change on the filter characteristics is not negligible, as shown in the top plan view of FIG. 11(*a*) and the cross-sectional view of FIG. 11(*b*), there is provided an air duct 70 continuing from the short side periphery of the transmission line (in this case, the first transmission line 24*a* of the second waveguide 24) enclosing the peripheries of the mirrors to the outer circumference thereof in the range between the radio-wave half mirrors 30A and 30B. Thereby, the air may easily flow between the space between the radio-wave half mirrors 30A and 30B and the outside thereof.

Here, as described above, there is a concern that providing the duct, which continues from the side periphery of the transmission line 24*a* to the outer circumference thereof, has an effect on the filter characteristics. However, it has been known that, compared with the long side of the rectangular transmission line, the effect of shape change on the short side is low (the characteristic change is small even when the width is increased up to around the cutoff wavelength). Further, although not shown in the drawings, in the case where the leakage of the electromagnetic waves through the air duct 70 is not negligible, by providing the groove 60 with the predetermined depth for inhibiting electromagnetic waves from leaking on the inner wall of the air duct 70, the leakage can be inhibited.

Figure 12:
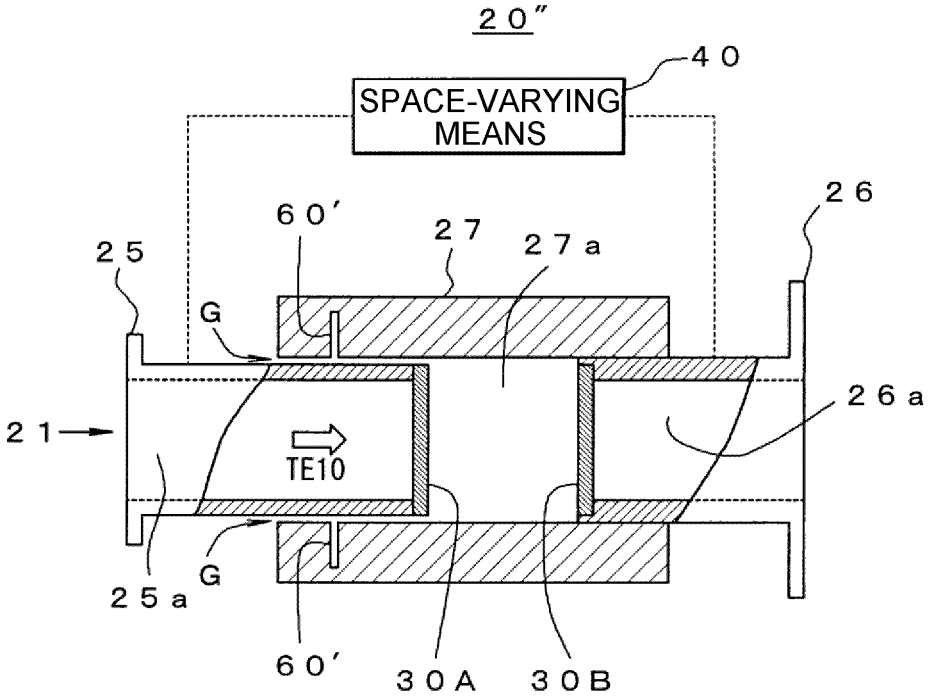
FIG. 12 is a diagram of a structure of a filter provided with the groove for inhibiting electromagnetic waves from leaking in the structure of three waveguides.

The groove for inhibiting electromagnetic waves from leaking can also be provided in the above-mentioned millimeter waveband filter formed of three waveguides. In this case, as shown in FIG. 12, the groove 60' with the predetermined depth for inhibiting electromagnetic waves from leaking is formed around the inner circumferential wall of the third waveguide 27 opposed with the gap G to the outer circumference of the waveguide (in this example, the first waveguide 25) sliding relative to the third waveguide 27 between the first waveguide 25 and the second waveguide 26 in which the transmission lines 25*a* and 26*a* have the same rectangular sizes and enter in sliding contact in the transmission line 27*a* of the third waveguide 27. With such a configuration, by inhibiting the electromagnetic waves between the pair of radio-wave half mirrors 30A and 30B from leaking out through the gap G necessary for the slide, the filter characteristics are kept high. Here, the second waveguide 26 is fixed in the third waveguide 27, and is integrally moved relative to the first waveguide 25.

Figure 13:
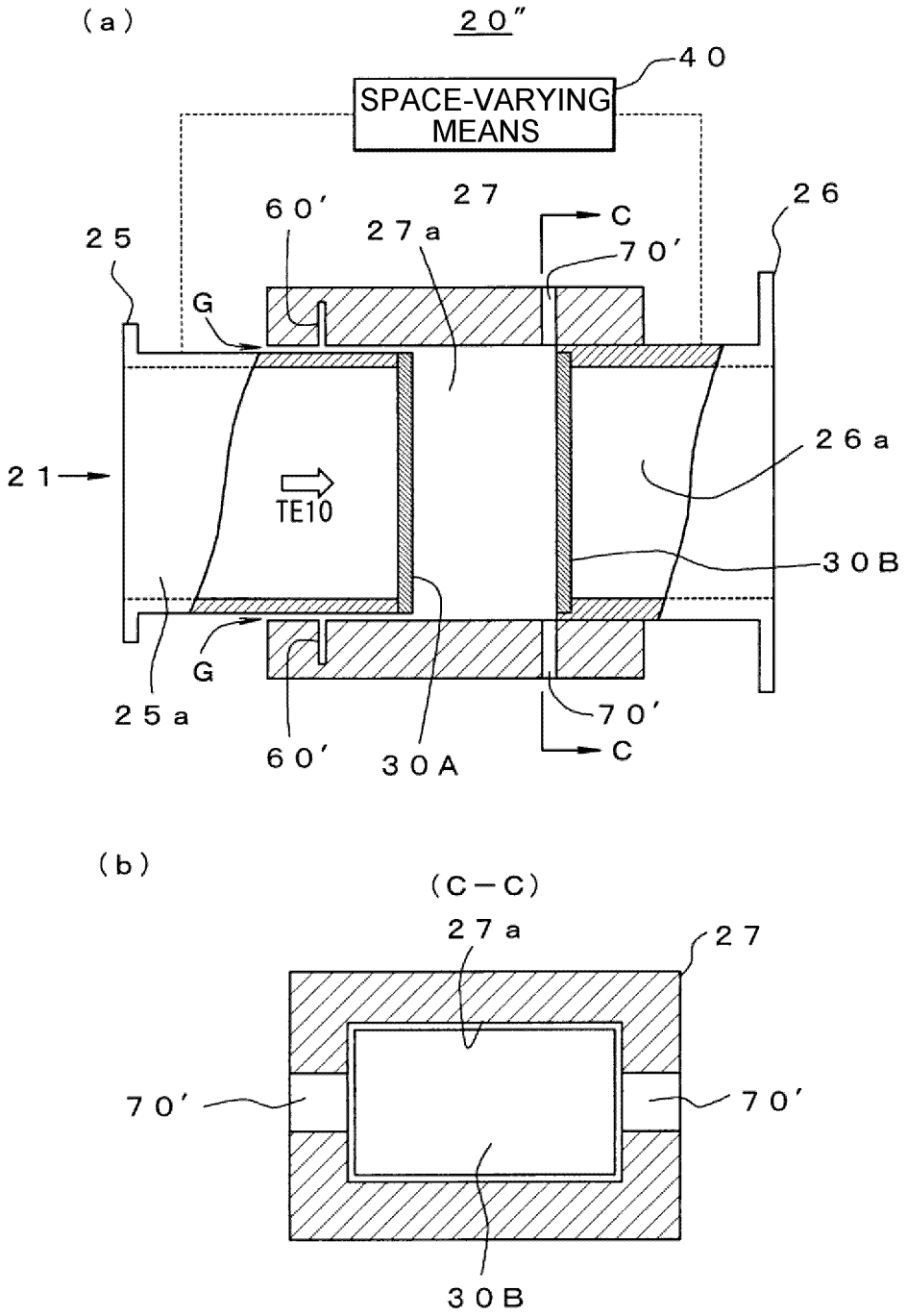
FIGS. 13*a* and 13*b* are diagrams of a structure of a filter provided with the air duct and the groove for inhibiting electromagnetic waves from leaking in the structure of three waveguides.

Further, in the millimeter waveband filter formed of three waveguides, as shown in FIG. 13, there is provided an air duct 70' which continues from the short side periphery of the transmission line 27*a* of the third waveguide 27 enclosing the peripheries of the mirrors to the outer circumference thereof in the range between the pair of radio-wave half mirrors 30A and 30B. Thereby, even when the gap G necessary for the slide is made to be narrow, it is possible to reduce the air resistance at the time of varying the frequency through the air duct 70', and thus it is possible to prevent the distortion of the radio-wave half mirrors caused by the air resistance from occurring. As a result, it is not necessary to apply excessive power to the slide.

In the configuration described hitherto, in order to vary the resonant frequency of the resonator, the space between the pair of radio-wave half mirrors is varied. However, the configuration described below may be adopted.

Figure 14:
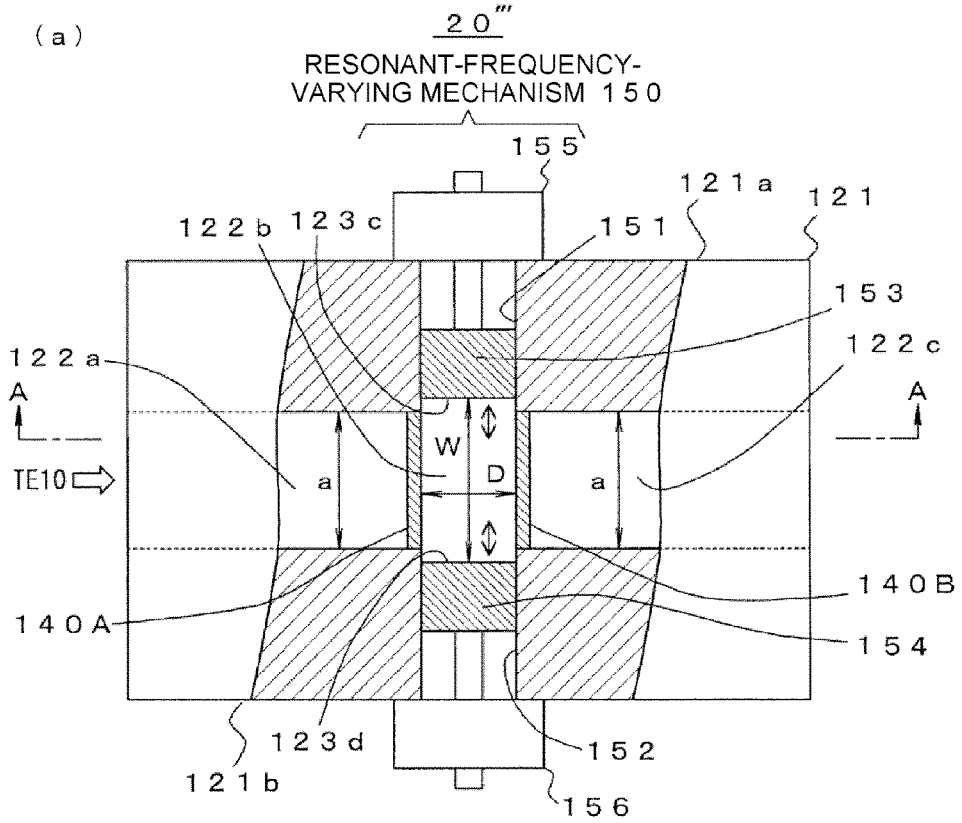
FIGS. 14*a* and 14*b* are diagrams of another basic structure of the millimeter waveband filter of the present invention.
Figure 14:
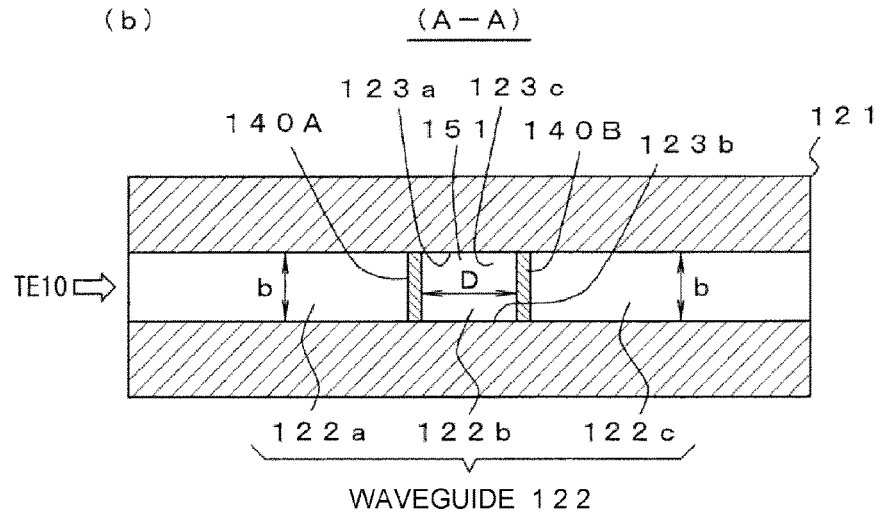

Hereinafter, another embodiment of the present invention will be described with reference to the accompanying drawings. FIG. 14 shows a basic structure of a millimeter waveband filter 20''' of the present invention.

As shown in FIG. 14(*a*), the millimeter waveband filter 20''' has a waveguide 121, a pair of radio-wave half mirrors 140A and 140B, and a resonant-frequency-varying mechanism 150.

The waveguide 121 is formed in a cross-sectional rectangular cylinder made of a metal material, and the transmission line 122, which has a rectangular size (for example, a rectangle with a width a×height b=2.032 mm×1.016 mm) capable of propagating the electromagnetic waves with a predetermined frequency range (for example 110 to 140 GHz) of the millimeter waveband in the TE10 mode (single mode), is linearly formed to continue from one end side to the other end side.

In the center portion of the waveguide 121, a pair of radio-wave half mirrors 140A and 140B, which have a characteristic of transmitting a part of the electromagnetic waves with the predetermined frequency range and reflecting a part thereof, are fixed opposite each other at a constant distance apart in a state where the mirrors block the transmission line 122.

Figure 15:
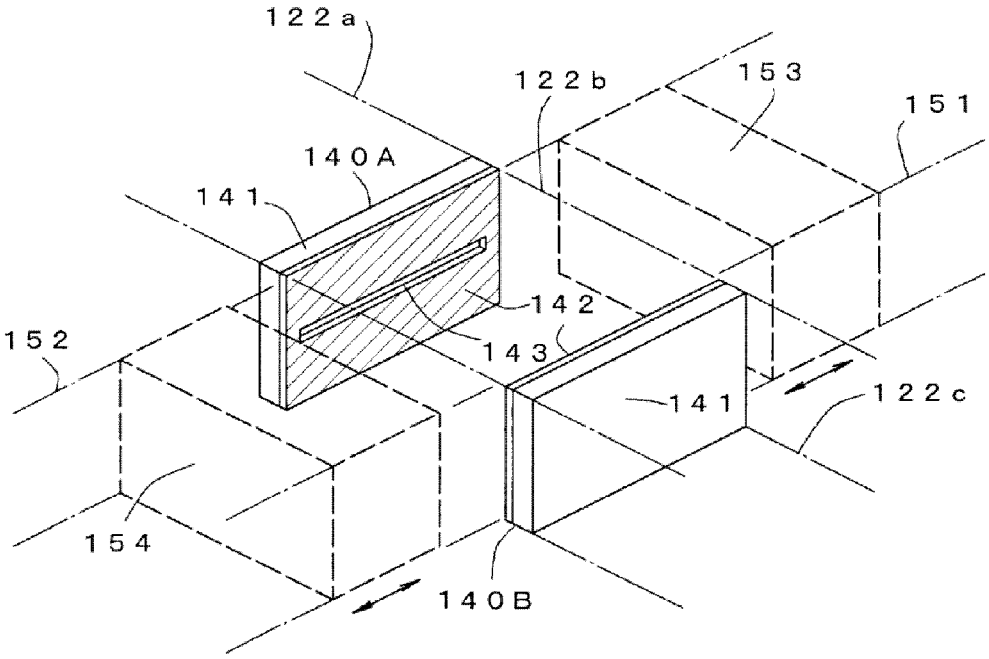
FIG. 15 is a diagram illustrating a relationship between the structure example of the radio-wave half mirrors and arrangement of a movable block.

For example, as shown in FIG. 15, the pair of radio-wave half mirrors 140A and 140B has a rectangular dielectric material substrate 141 that has a size corresponding to the rectangular size of the fixed transmission line 122, a metal film 142 that covers the surface thereof, and a slit 143 that is provided on the metal film 142 and is for transmitting the electromagnetic waves. The outer circumference of the metal film 142 is fixed to be in contact with the inner wall of the transmission line 122. With such a configuration, the mirrors transmit electromagnetic waves at the transmittance corresponding to the shape or the area of the slit 143.

The transmission line 122 enclosed by the inner wall of the waveguide 121 is partitioned by the two radio-wave half mirrors 140A and 140B into a first transmission line 122*a*, a second transmission line 122*b*, and a third transmission line 122*c*.

In addition, the space W between the wall surfaces 123*c* and 123*d*, which correspond to the short sides of the rectangle, among four wall surfaces 123*a* to 123*d* enclosing the second transmission line 122*b* which has a cross-sectional rectangular shape formed between the pair of radio-wave half mirrors 140A and 140B can be varied by a resonant-frequency-varying mechanism 150.

That is, in the waveguide 121, guide holes 151 and 152, which respectively continue from both side surfaces corresponding to the short sides of the second transmission line 122*b* to both side surfaces 121*a* and 121*b* of the waveguide 121 along the long side direction, are formed to penetrate therethrough.

The heights of the guide holes 151 and 152 almost coincide with the height b (short side=1.016 mm) of the second transmission line 122*b*, and the widths of the guide holes 151 and 152 coincide with the length (here, it is the same as the space D between the radio-wave half mirrors 140A and 140B) in the propagation direction of the second transmission line 122*b*.

In addition, in the guide holes 151 and 152, rectangular parallelepiped and metallic movable blocks 153 and 154, which are housed such that the four side surfaces thereof is inscribed in the inner circumference of the guide holes 151 and 152 and are slidable in the long side direction of the cross-sectional rectangle second transmission line 122*b*, are disposed.

Consequently, the inner surface sides of the two movable blocks 153 and 154 opposed to each other form the wall surfaces 123*c* and 123*d* corresponding to the short sides of the second transmission line 122*b*.

The two movable blocks 153 and 154 are connected to driving devices 155 and 156 fixed on the side surfaces 121*a* and 121*b* of the waveguide 121, and the driving devices 155 and 156 change the space therebetween, that is, the space W between the wall surfaces 123*c* and 123*d* on the short side of the second transmission line 122*b*. Here, it is preferable that the driving devices 155 and 156 increase, for example, the space W by about 2 mm from 2.032 mm which is the long side length of the first transmission line 122*a* and the third transmission line 122*c*, and the driving devices 155 and 156 may include a stepping motor, a servo motor, or a solenoid as a driving source.

As described, by varying the space W between the wall surfaces corresponding to the short sides of the second transmission line 122*b* between the pair of radio-wave half mirrors 140A and 140B, it is possible to vary the resonant frequency of the resonator formed between the radio-wave half mirrors 140A and 140B.

That is, it has been known that the guide wavelength λg of the waveguide is represented by the following expression.

$$\lambda g = \lambda / [1 - (\lambda/\lambda_{C10})^2]^{1/2} = \lambda / [1 - (\lambda/2a')^2]^{1/2}$$

λ: the free space wavelength, $\lambda_{C10}$: the cutoff frequency of the TE10 mode a': the long side of the opening of the waveguide In addition, the resonance wavelength (the center wavelength of the passband) of the filter with the structure, in which the radio-wave half mirrors 140A and 140B are opposed to each other, is ½ of the guide wavelength λg. Hence, by varying the long side a' of the second transmission line 122*b*, that is, the space W between the wall surfaces corresponding to the short sides of the second transmission line 122*b*, it is possible to vary the resonant frequency of the filter.

Figure 16:
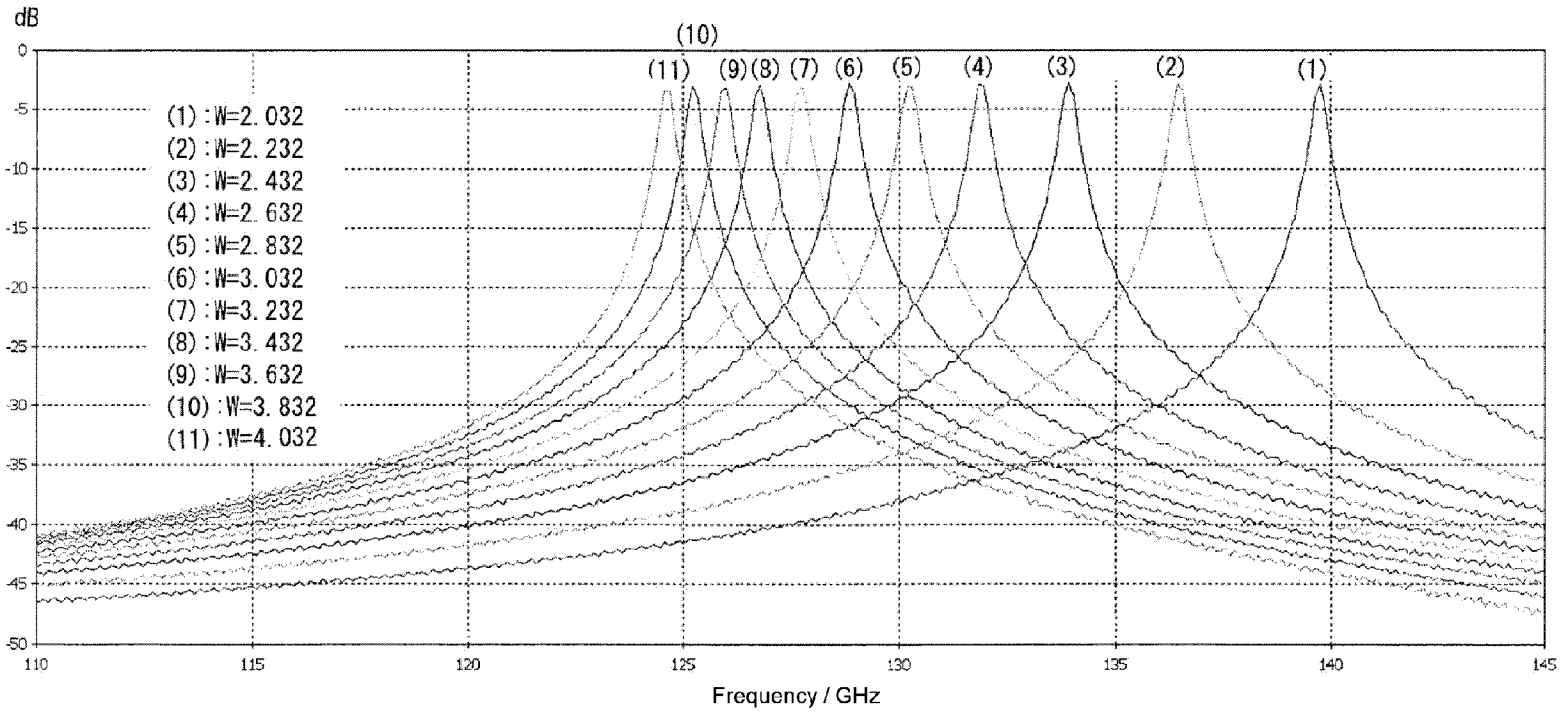
FIG. 16 is a simulation result indicating change in characteristics of the filter at the time of varying the space between the wall surfaces corresponding to the short sides of the transmission line between the radio-wave half mirrors.

FIG. 16 is a result of a simulation of change in the resonant frequency at the time of changing the space W between the wall surfaces corresponding to the short sides of the second transmission line 22*b* from 2.032 mm (=a) to 4.032 mm in incremental steps of 0.2 mm (changing both movable blocks 153 and 154 symmetrically with respect to the transmission line center) at half mirror space D of 1.28 mm.

As can be clearly seen from the drawing, it is possible to vary the resonant frequency in the range of approximately 125 GHz to 140 GHz.

In the millimeter waveband filter 20''' having the structure, the plane-type Fabry-Perot resonator, which resonates at ½ of the guide wavelength of the second transmission line 122*b* formed between the pair of radio-wave half mirrors 140A and 140B opposed to each other, is formed, and only the frequency component centered on the resonant frequency is selectively transmitted therethrough.

Further, the transmission line 122 has a structure of the waveguide as the closed-type transmission channel which has extremely low loss in the millimeter waveband, and uses the transverse electric waves of which the electric field is present only in the plane orthogonal to the traveling direction. Hence, the processes such as wavefront conversion are not necessary, and thus only the signal component extracted through the resonator can be output with extremely low loss in the TE10 mode.

Furthermore, the entire filter is hermetically formed, in principle there is less loss caused by radiation to the surroundings, and it is possible to achieve an extremely high selective property in the millimeter waveband.

In addition, in the millimeter waveband filter 20", by varying the space W between the wall surfaces corresponding to the short sides of the second transmission line 122*b* formed between the pair of radio-wave half mirrors 140A and 140B, the resonant frequency of the resonator formed between the radio-wave half mirrors 140A and 140B is varied. Hence, the external circuit is fixedly connected to both ends (both ends of the waveguide 121) of the filter, and thus the other transmission line for movement absorption tube is not necessary. As a result, the entire filter is formed to have a small size.

Figure 17:
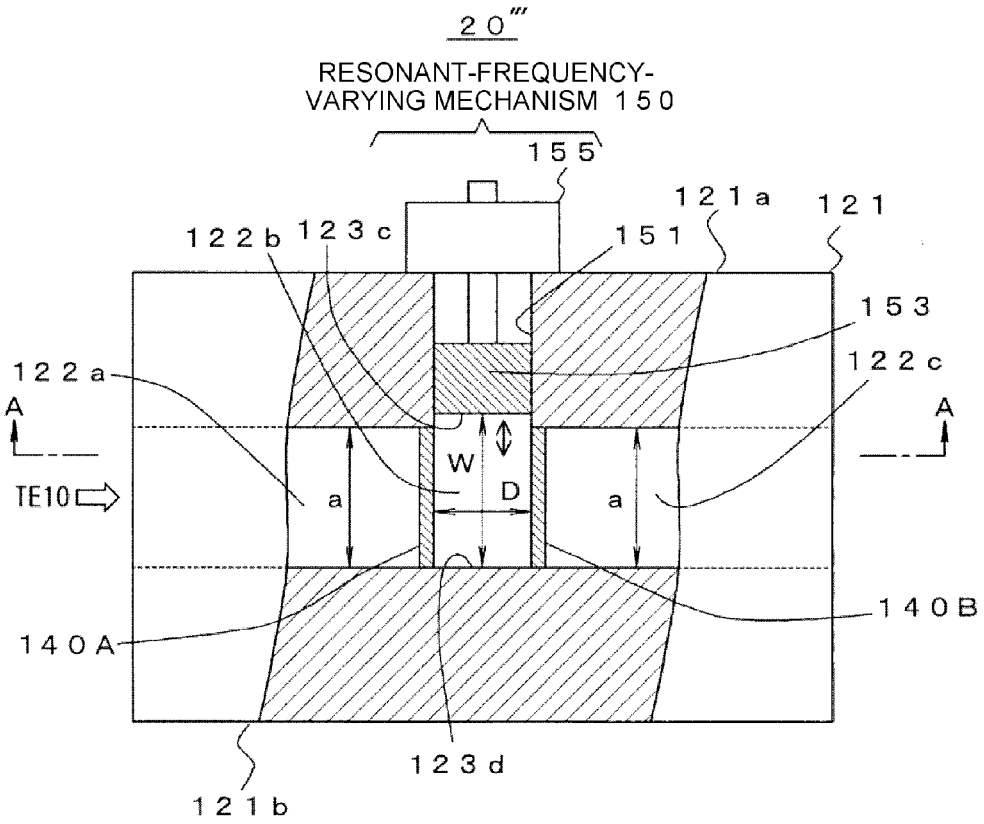
FIG. 17 is a diagram of a structure of a filter in which only one wall surface is movable.

It should be noted that, here, the space is varied by moving both wall surfaces corresponding to the short sides of the second transmission line 122*b* formed between the pair of radio-wave half mirrors 140A and 140B, but as shown in FIG. 17, it is possible to vary the resonant frequency even when only one wall surface is movable.

Further, in the embodiment, the basic structures of the waveguide 21 and the resonant-frequency-varying mechanism are typical, but real structures thereof can be arbitrarily changed.

In addition, when the movable blocks 153 and 154 are moved at a comparatively high speed with the structure, the volume of the space between the pair of radio-wave half mirrors 140A and 140B increases or decreases. However, air present therein does not flow out through the narrow gap G, the internal pressure is changed, and the thin radio-wave half mirrors 140A and 140B are distorted by the pressure, and the resonant frequency of the filter deviates from a desired value. Thus, there is a possibility that a problem arises in that for example the loss increases.

Figure 18:
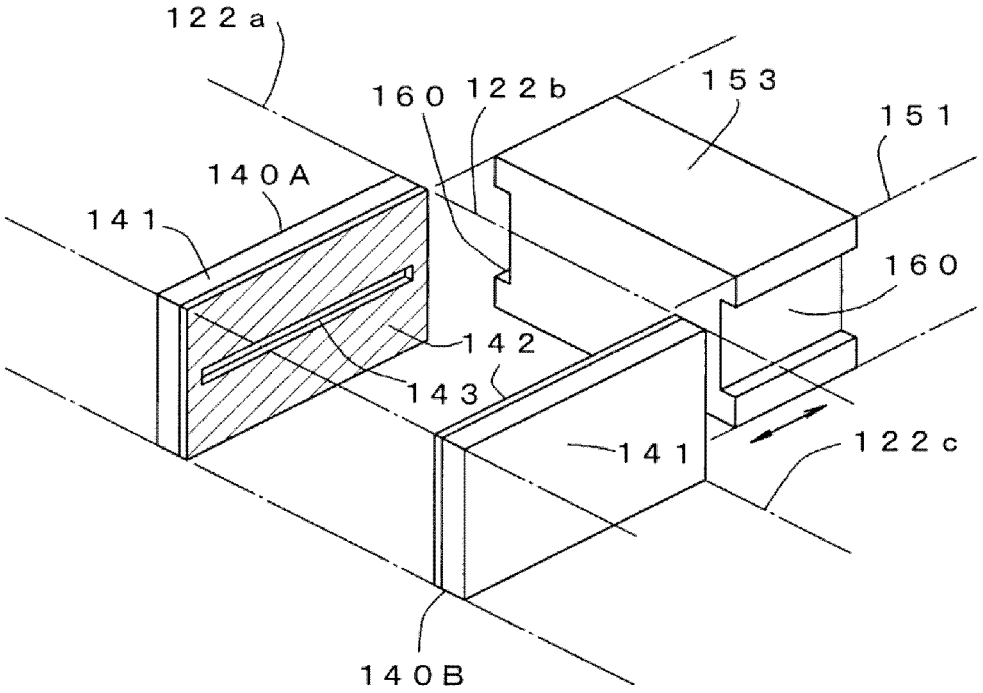
FIG. 18 is a diagram illustrating an example in which the air duct is provided on the movable block.

In the case where the effect of the pressure change on the filter characteristics is not negligible, there is provided an air duct which continues from the wall surfaces corresponding to the short sides of the second transmission line 122*b* to the outer circumferential surface of the waveguide 121. Thereby, the air may easily flow between the waveguide outside and the space between the radio-wave half mirrors 140A and 140B. FIG. 18 shows an example thereof. Thus, an air duct 160 is formed on the side portion of the movable block 153 constituting the wall surfaces corresponding to the short sides of the second transmission line 122*b*, and thus the air may easily flow between the inside of the transmission line and the outside of the waveguide 21.

In addition, as described above, there is a concern that occurrence of the space between the second transmission line 122*b* and the waveguide outside has an effect on the filter characteristics. However, it has been known that an adverse effect of the shape change on the short side is small as compared with the long side of the rectangular transmission line, and it can be observed that there is no problem in discharge of air. Here, the air duct 160 is provided on the movable block 153. However, an air duct may be provided on the guide hole 151 side, or an air duct, which penetrates from the immovable wall surface 123*d* to the side surface 121*b* of the waveguide 121 as shown in FIG. 17, may be provided.

Here, another embodiment of the radio-wave half mirror applicable to the millimeter waveband filters 20, 20', 20", and 20'" described hitherto will be described.

Figure 19:
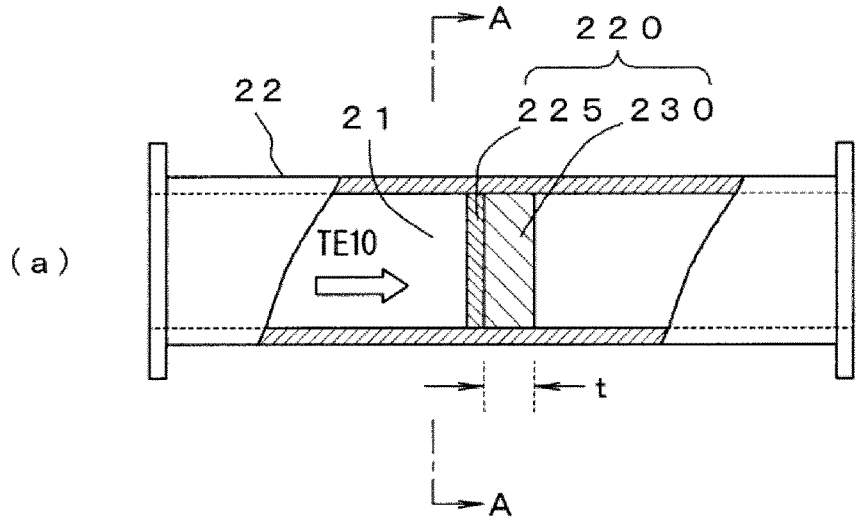
FIGS. 19*a* and 19*b* are diagrams of a structure in which the radio-wave half mirror is disposed in the transmission line.
Figure 19:
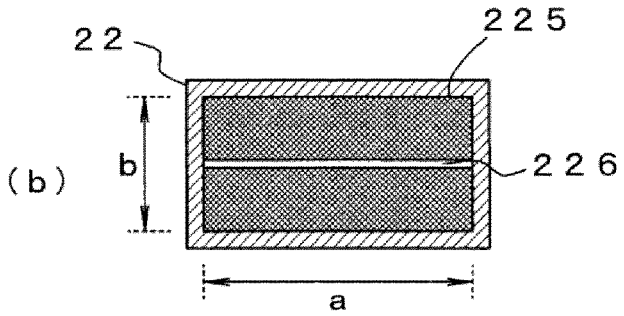

FIG. 19 shows a structure of a radio-wave half mirror 220, where FIG. 19(*a*) is a side view and FIG. 19(*b*) is a cross-sectional view taken along the line A-A.

The radio-wave half mirror 220 is fixed to block the transmission line 21 formed in the rectangular waveguide 22 with the internal rectangular size (a×b=2.032 mm×1.016 mm) capable of propagating electromagnetic waves in a single mode (TE10 mode) in the millimeter waveband (for example F band).

The radio-wave half mirror 220 includes a half mirror body 225 and a dielectric plate 230. The half mirror body 225 has a structure in which a slit 226 for transmitting electromagnetic waves is provided in a rectangular metal plate having a predetermined thickness (for example, 10 μm) and the same shape as the internal rectangular size of the waveguide 22 and inscribed in the waveguide 22. Here, for example as shown in FIG. 19(*b*), the slit 226 is formed with a width of 10 μm across the center of the half mirror body 225 along the long side of the opening of the waveguide 22. In practice, the half mirror body 225 is formed by performing the etching process (or metal evaporation) on a metal layer which is provided in advance with a thickness of 10 μm on the surface of the dielectric plate 230, and is thus supported by the surface of the dielectric plate 230.

The dielectric plate 230 has a predetermined thickness t and a predetermined permittivity (relative permittivity) $\in r$, has the same shape as the half mirror body 25, and is disposed in tight contact with the one surface side thereof.

As described above, when the dielectric plate 230 is disposed inside the transmission line 11, breakpoints in permittivity occur on both end faces of the dielectric plate 230, the radio waves are reflected at the points, and resonance phenomenon occurs at the frequency determined when the electrical length between the end surfaces of the dielectric plate 230 is a half wavelength (dielectric resonator). The resonant frequency depends on the thickness t and the permittivity $\in r$ of the dielectric plate 230, and the resonance characteristic and the transmission characteristic of the half mirror body 225 are combined into the overall transmittance characteristics. Hence, through the appropriate combination of both characteristics, it is possible to obtain transmittance characteristics which are smooth in the whole range.

Figure 20:
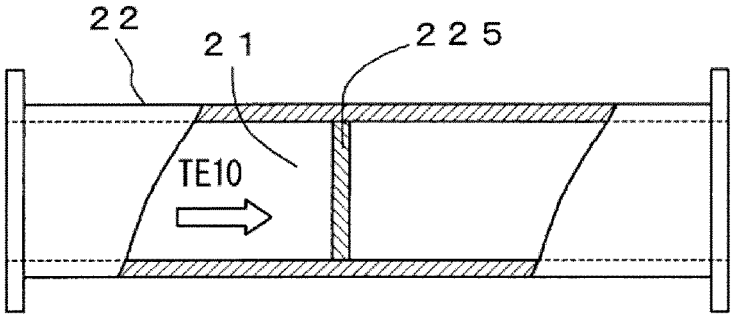
FIG. 20 is a diagram of a structure in which only a half mirror body is disposed in the transmission line.
Figure 21:
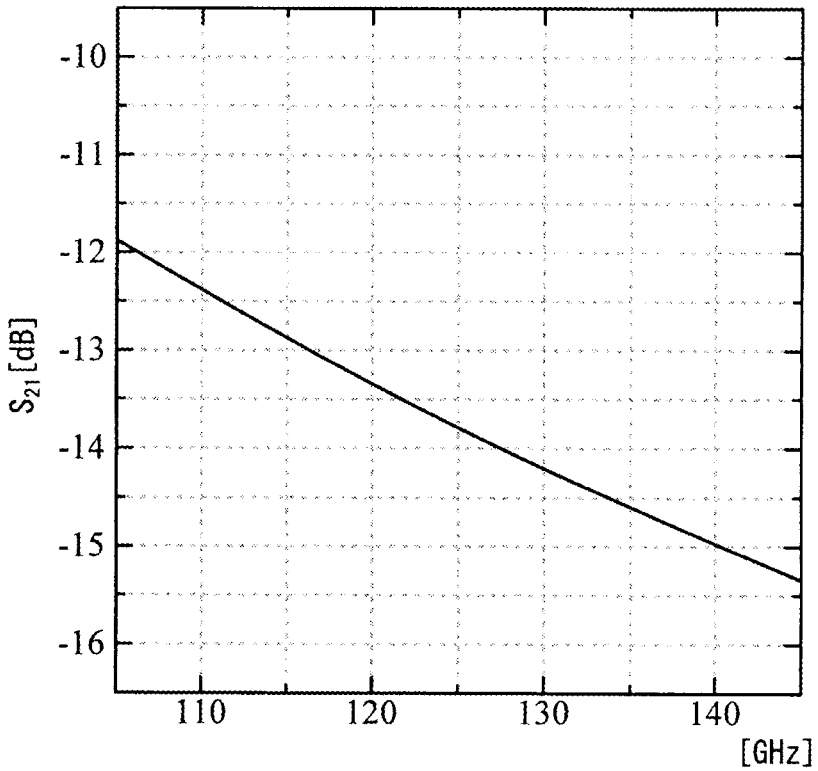
FIG. 21 is a diagram of a transmittance characteristic of the structure of FIG. 20.

Next, a result of simulation on characteristics of the radio-wave half mirror 220 with the structure will be described. First, FIG. 21 shows a transmittance characteristic of the structure in which only the half mirror body 225 is disposed in the transmission line 11 as shown in FIG. 20. The transmittance characteristic deteriorates as the frequency increases at a substantially constant slope in the range of 110 GHz to 140 GHz. The reason is that the slit 226, which extends in the long side direction of the waveguide, is equivalent to a grounded capacitor circuit and deteriorates the high-frequency component thereof (low-pass characteristic). Consequently, by using only the half mirror body 225, it can hardly be expected to obtain a transmittance characteristic which is smooth in the desired frequency range (110 GHz to 140 GHz).

Figure 22:
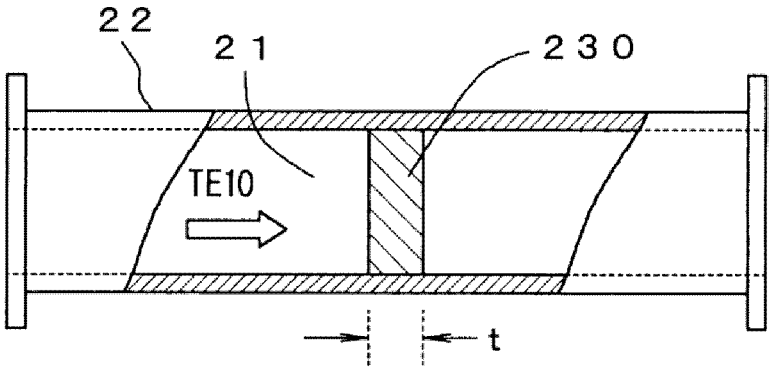
FIG. 22 is a diagram of a structure in which only a dielectric plate is disposed in the transmission line.
Figure 23:
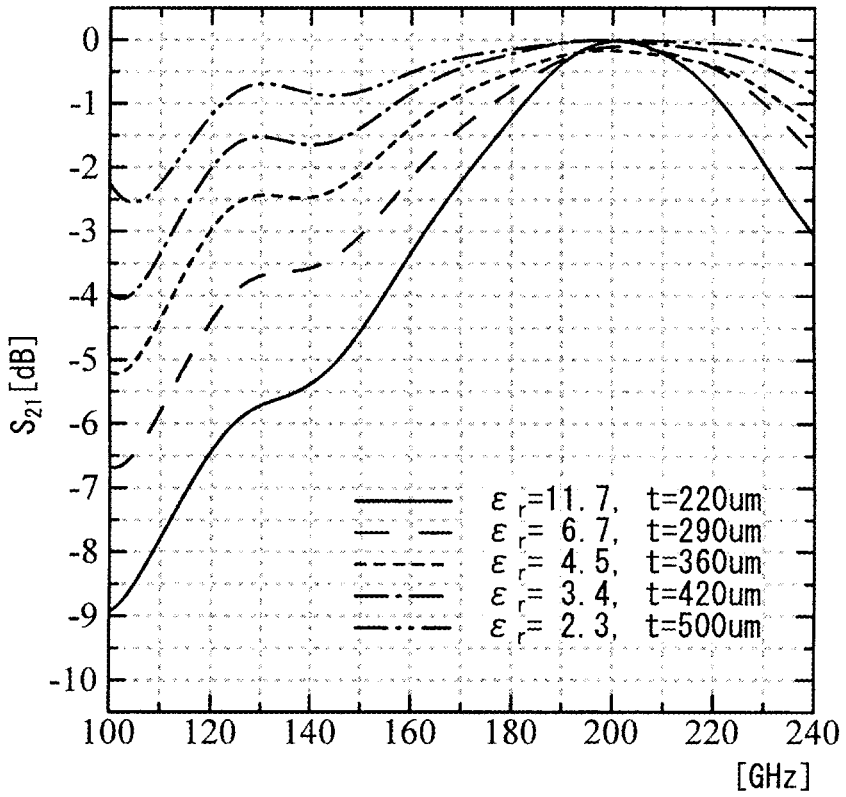
FIG. 23 is a diagram of transmittance characteristics of the structure of FIG. 22.
Figure 24:
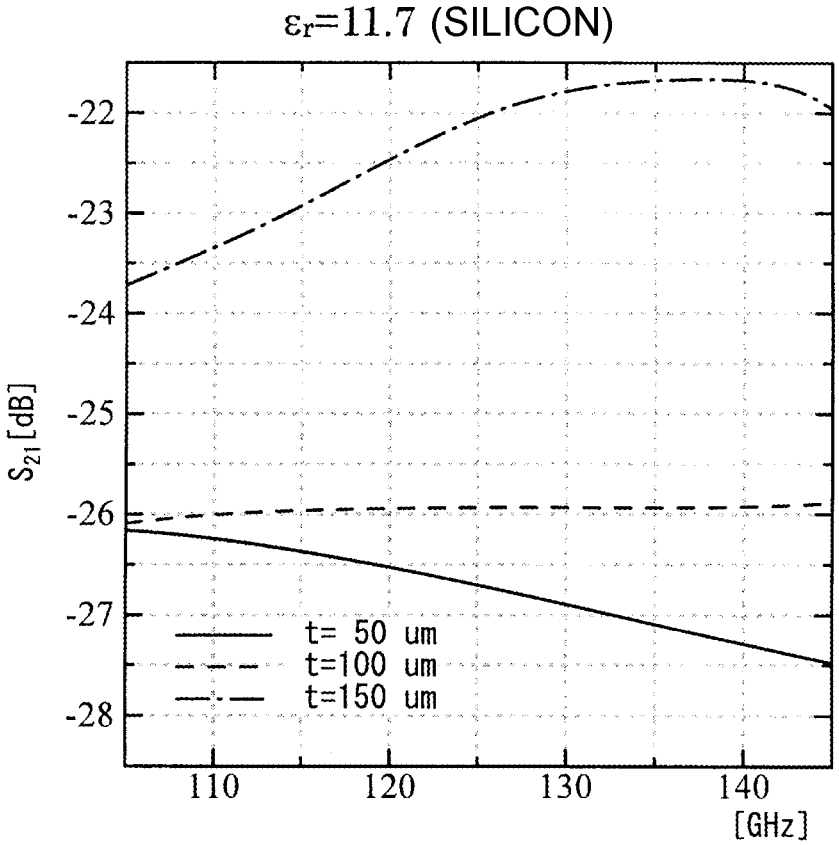
FIG. 24 is a diagram of overall transmittance characteristics in a case where the dielectric plate is silicon.
Figure 25:
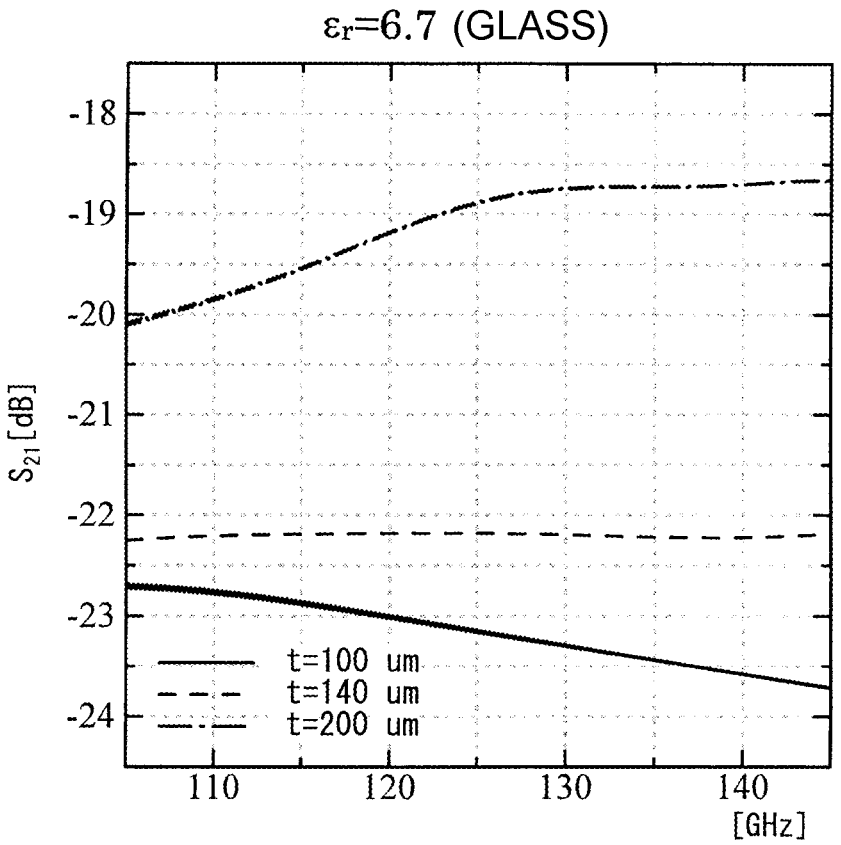
FIG. 25 is a diagram of overall transmittance characteristics in a case where the dielectric plate is glass.
Figure 26:
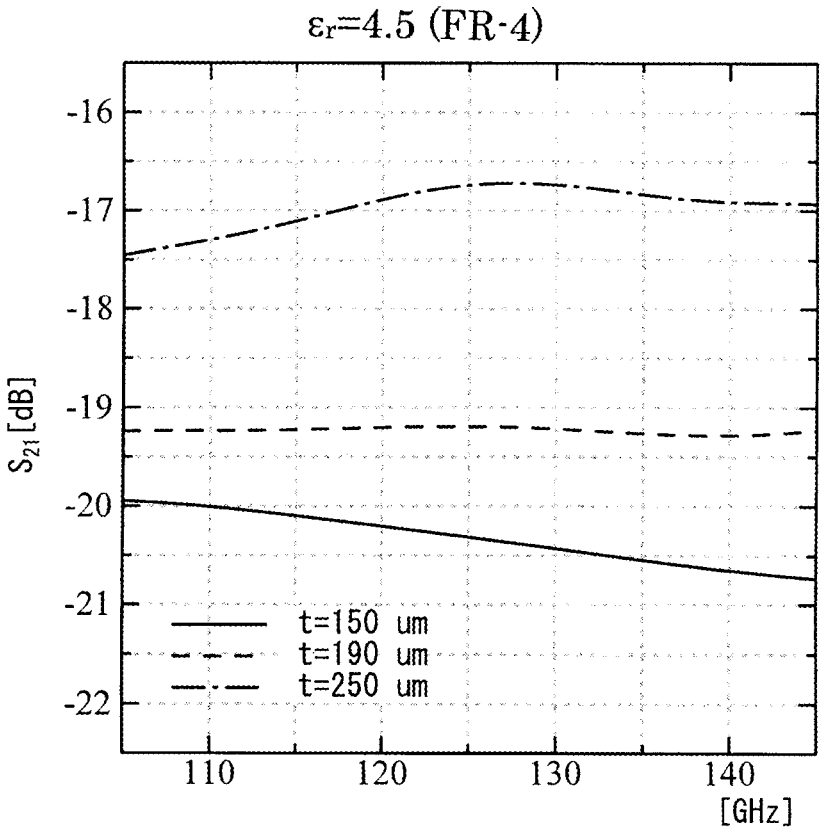
FIG. 26 is a diagram of overall transmittance characteristics in a case where the dielectric plate is FR-4.
Figure 27:
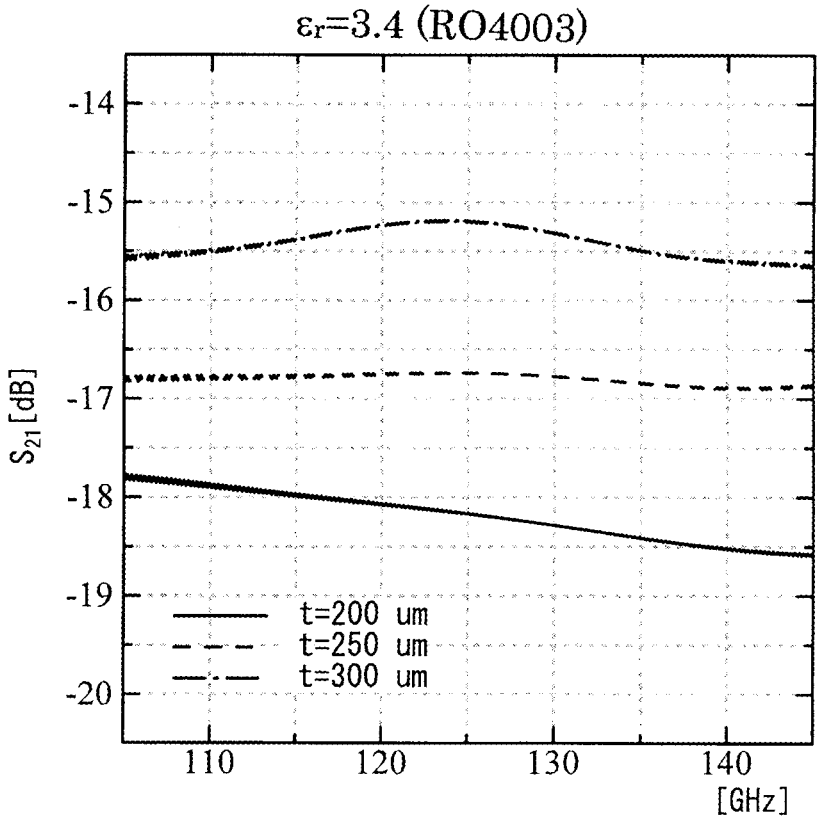
FIG. 27 is a diagram of overall transmittance characteristics in a case where the dielectric plate is RO4003.

Next, FIG. 23 shows a transmittance characteristic of the structure in which only the dielectric plate 230 is disposed in the transmission line 11 as shown in FIG. 22. Here, the used material (permittivity) of the dielectric plate 230 includes five materials of silicon ($\in r$=11.7), glass ($\in r$=6.7), glass epoxy FR-4 ($\in r$=4.5), RO4003 ($\in r$=3.4), and Teflon (registered trademark) ($\in r$=2.3), and the thickness t of each material is selected such that the resonant frequency is 200 GHz.

In such a transmittance characteristic of each dielectric material, the characteristic in the desired frequency range of 110 GHz to 140 GHz has a slope that increases as the frequency increases. Further, a degree of the slope slightly fluctuates but tends to be smoothly changed, and as the permittivity becomes larger, the frequency band becomes narrower, and the absolute amount of the transmittance tends to become lower. Such a transmittance characteristic of the dielectric material is horizontally shifted by changing the set value of the resonant frequency. Therefore, by selecting a material and a thickness thereof, it is possible to set the characteristic of the desired frequency range with a high degree of freedom. In addition, by combining this characteristic with the characteristic of FIG. 21, it is possible to achieve a smooth (or different) characteristic. Specifically, by using the dielectric plate of which one side has a metal layer and changing the thickness t of the dielectric plate, the overall transmittance characteristics may be made to be approximate to the desired characteristic.

FIGS. 24 to 28 show results of the design for making the transmittance characteristic smooth in the desired frequency range of 110 GHz to 140 GHz. In the case of silicon of FIG. 24, t=100 μm, in the case of glass of FIG. 25, t=140 μm, in the case of FR-4 of FIG. 26, t=190 μm, and in the case of RO4003 of FIG. 27, t=250 μm. From these results, it can be seen that the frequency characteristic of transmittance can be smoothed to a tolerance of about ±0.1 dB.

Figure 28:
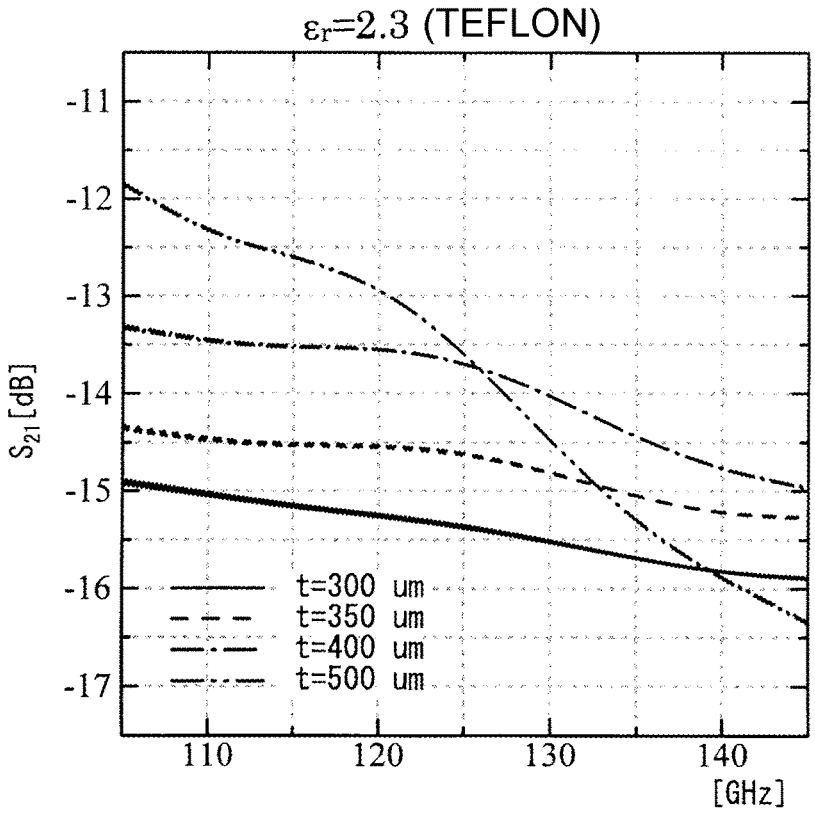
FIG. 28 is a diagram of overall transmittance characteristics in a case where the dielectric plate is Teflon (registered trademark).

Further, in the case of Teflon (registered trademark) of FIG. 28, even by adjusting the thickness of the dielectric plate 230, it is difficult to obtain a smooth characteristic. From the characteristics of FIG. 23, it can be inferred that the reason is that, if the permittivity is low, the slope of the transmittance is gentle and it is difficult to sufficiently eliminate the downward-sloping characteristic of the half mirror body 225. For this reason, when the invention is limited to the above-mentioned structure including the slit of the half mirror body 225, in order to achieve overall smooth transmittance characteristics, it is necessary to employ the dielectric plate with permittivity ∈r of 3.4 or more.

However, the shape, the number, or the direction of the slit provided on the half mirror body 225 changes the transmittance characteristic (particularly the slope) of the half mirror body 225. Therefore, it is preferable to select the permittivity and the thickness of the dielectric plate 30 in accordance therewith, and the characteristic is likely to be smoothed even when the permittivity ∈r is less than 3.4.

In addition, here, one slit 226 along the long side direction of the waveguide is provided on the half mirror body 225. However when the slit is provided in the short side direction of the waveguide, a grounded inductance circuit is equivalently formed, and has a characteristic (high-pass characteristic) in which the transmittance in the low frequency band is lower than that in the high frequency band. Hence, when the transmittance is lowered as the frequency increases in the range of 100 GHz to 140 GHz by setting the resonant frequency of the resonator to for example about 60 GHz through the dielectric plate 230, the slope thereof can be made to be inverse to that of the transmittance characteristic of the half mirror body 225, and it is possible to smooth the overall transmittance characteristics by selecting the material or the thickness thereof in a similar manner as described above.

As described above, in the radio-wave half mirror, the dielectric plate is disposed on one surface side of the half mirror body, and the dielectric resonator is formed, the slope of the transmittance characteristic of the half mirror body is inverse to the slope of the transmittance characteristic of the dielectric plate, and the degrees of inclination thereof are set to be the same. Hence, the overall transmittance characteristics of the radio-wave half mirror are smoothed in the desired frequency range of the millimeter waveband, and thus it is possible to obtain a uniform transmittance characteristic in a wide frequency range of the millimeter waveband. Consequently, the resonator is appropriate for various circuits including the filter.

Figure 29:
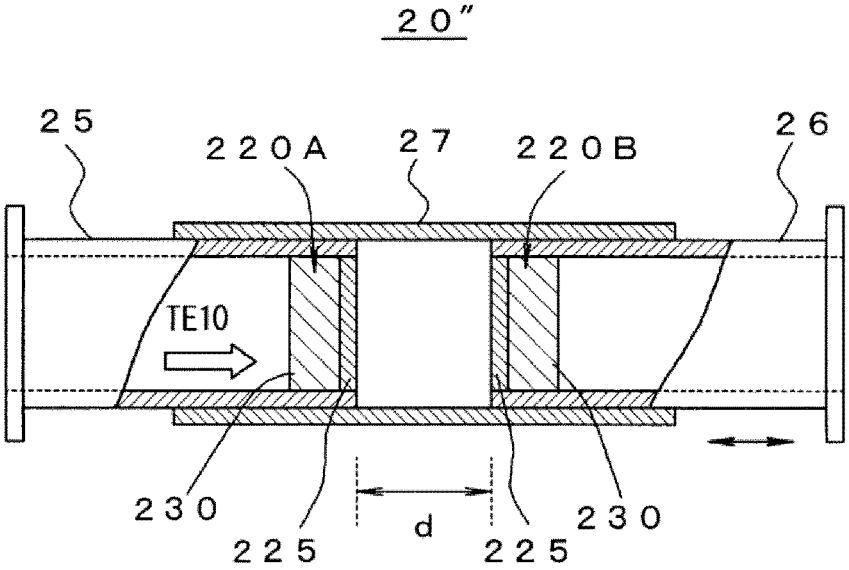
FIG. 29 is a diagram of another example of a structure using three waveguides.

FIG. 29 shows a millimeter waveband filter 20" using a structure of the radio-wave half mirror 220.

The filter 20" is a filter in which the radio-wave half mirror 220 is applied to the aspect shown in FIG. 4. The first waveguide 25 and the second waveguide 26, which are for the F band and have the same rectangular size, are disposed on the same axis such that the end faces thereof are opposed to each other, and the end portions thereof are inserted into the both ends of the third waveguide 27 with a rectangular size, which is slightly larger than those of the tubes, so as to be in sliding contact therein. Thus, the three continuous waveguides 25 to 27 form a transmission line that propagates electromagnetic waves with a desired frequency range of the millimeter waveband in a single mode.

In addition, radio-wave half mirrors 220A and 220B, in which the half mirror body 225 and the dielectric plate 230 are integrated in a similar manner as described above, are mounted on the end portions of the first waveguide 25 and the second waveguide 26, and at least one of the first waveguide 25 and the second waveguide 26 is slidable in the lengthwise direction in a state where it is held by the third waveguide 27.

Consequently, the plane-type Fabry-Perot resonator is formed between the two radio-wave half mirrors 220A and 220B opposed to each other, and the space d is set to be variable. Therefore, it is possible to change the resonant frequency, and the wavefront conversion is not necessary. Accordingly, it is possible to achieve a filter which is capable of varying the frequency of the millimeter waveband with characteristics which are uniform in a wide frequency range due to the effect of the radio-wave half mirror without loss caused by external radiation.

DESCRIPTION OF REFERENCE NUMERALS AND SIGNS

20, 20', 20", 20'": MILLIMETER WAVEBAND FILTER
21, 23*a*, 24*a*, 24*b*, 25*a*, 26*a*, 27*a*: TRANSMISSION LINE
22 to 27: WAVEGUIDE
30A, 30B: RADIO-WAVE HALF MIRROR
31: METAL PLATE
32: SLIT
40: SPACE-VARYING MEANS
51: DIELECTRIC MATERIAL
52: PERMITTIVITY-VARYING MEANS
60, 60': GROOVE
70, 70': AIR DUCT
121: WAVEGUIDE
122: TRANSMISSION LINE
122*a*: FIRST TRANSMISSION LINE
122*b*: SECOND TRANSMISSION LINE
122*c*: THIRD TRANSMISSION LINE
123*a* to 123*d*: WALL SURFACE
140A, 140B: RADIO-WAVE HALF MIRROR
141: DIELECTRIC MATERIAL SUBSTRATE
142: METAL FILM
143: SLIT
150: RESONANT-FREQUENCY-VARYING MECHANISM
151, 152: GUIDE HOLE
153, 154: MOVABLE BLOCK

155, 156: DRIVING DEVICE
160: AIR DUCT
220: RADIO-WAVE HALF MIRROR
225: HALF MIRROR BODY
226: SLIT
230: DIELECTRIC PLATE

The invention claimed is:

1. A millimeter wave band filter comprising:

a transmission line that is formed by a plurality of waveguides and into which electromagnetic waves with a predetermined frequency range of a millimeter wave band are incident and which propagates the corresponding incident electromagnetic waves from one end to the other end in a TE10 mode; and a pair of radio-wave half mirrors that are disposed opposite each other with a space interposed therebetween so as to block the inside of the transmission line and have planar shapes and a characteristic of transmitting a part of the electromagnetic waves with the predetermined frequency range and reflecting another part thereof, wherein in the electromagnetic waves incident from a side of the one end of the transmission line, a frequency component centered on a resonant frequency of a resonator, which is formed between the pair of radio-wave half mirrors, is selectively output from the other end of the transmission line, wherein in order to change an electrical length between the pair of radio-wave half mirrors, at least one of space-varying means, which varies a space between the pair of radio-wave half mirrors, and permittivity-varying means, which varies permittivity of a dielectric material inserted between the pair of radio-wave half mirrors, is provided, wherein the transmission line is formed of a first waveguide which has an internal rectangular size capable of propagating the electromagnetic waves with the predetermined frequency range from one end of the first waveguide to the other end of the first waveguide in the TE10 mode, and a second waveguide which has an internal rectangular size capable of propagating the electromagnetic waves with the predetermined frequency range from one end of the second waveguide to the other end of the second waveguide in the TE10 mode and is connected to the first waveguide so as to be circumscribed around a portion of the one end of the first waveguide, wherein one of the pair of radio-wave half mirrors is mounted on the first waveguide, and the other is mounted on the second waveguide, and wherein the space-varying means varies the space between the pair of radio-wave half mirrors by telescopically sliding the first waveguide and the second waveguide in a state where the waveguides are connected.

2. The millimeter waveband filter according to claim 1, wherein in the second waveguide, a first transmission line, which has a rectangular size capable of housing the one end side of the first waveguide with a gap necessary to slide the one end side, and a second transmission line, which has a rectangular size equal to that of a part of a transmission line of the first waveguide, are integrally formed so as to be concentrically successive, and a groove with a predetermined depth for inhibiting electromagnetic waves from leaking is formed around an inner circumferential wall of the first transmission line which is opposed to an outer circumference of the first waveguide with the gap.

3. The millimeter waveband filter according to claim 1, wherein an air duct, which extends from an inner circumference of the second waveguide to an outer circumference thereof, is provided between the pair of radio-wave half mirrors.

4. The millimeter waveband filter according to claim 2, wherein an air duct, which extends from an inner circumference of the second waveguide to an outer circumference thereof, is provided between the pair of radio-wave half mirrors.

* * * * *